US006092939A

United States Patent [19]

Nishikori et al.

[11] Patent Number: 6,092,939

[45] Date of Patent: Jul. 25, 2000

[54] PRINTING APPARATUS AND PRINTING REGISTRATION METHOD

[75] Inventors: Hitoshi Nishikori, Inagi; Naoji Ohtsuka, Yokohama; Kiichiro Takahashi, Kawasaki; Osamu Iwasaki, Tokyo; Minoru Teshigawara, Urawa; Toshiyuki Chikuma, Tokyo, all of Japan

[73] Assignee: Canon Kabushiki Kaisha, Tokyo, Japan

[21] Appl. No.: 09/055,331

[22] Filed: Apr. 6, 1998

[30] Foreign Application Priority Data

Apr. 4, 1997 [JP] Japan ..... 9-086611
Apr. 3, 1998 [JP] Japan ..... 10-091475

[51] Int. Cl.[7] ..... B41J 5/30

[52] U.S. Cl. ..... 400/61; 400/120.01; 400/120.09; 400/120.1; 347/188; 347/190

[58] Field of Search ..... 400/61, 120.01, 400/120.09, 120.1, 124.08; 347/188, 190

[56] References Cited

U.S. PATENT DOCUMENTS

| | | | |
|---|---|---|---|
| 2,869,455 | 1/1959 | Knutsen | 400/124.08 |
| 4,313,124 | 1/1982 | Hara | 346/140 R |
| 4,345,262 | 8/1982 | Shirato et al. | 346/140 R |
| 4,389,935 | 6/1983 | Arai | 347/190 |
| 4,415,908 | 11/1983 | Sugiura | 347/190 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,566,813 | 1/1986 | Kobayashi et al. | 400/120.1 |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,163,760 | 11/1992 | Narduzzi | 347/190 |
| 5,488,398 | 1/1996 | Matsubara et al. | 347/43 |
| 5,611,630 | 3/1997 | Dolan et al. | 400/120.1 |
| 5,675,370 | 10/1997 | Austin et al. | 347/188 |
| 5,686,998 | 11/1997 | Clark et al. | 347/188 |
| 5,751,310 | 5/1998 | Yano et al. | 347/43 |
| 5,765,953 | 6/1998 | Takahashi | 400/120.09 |
| 5,902,053 | 5/1999 | Ikemoto et al. | 400/120.09 |

FOREIGN PATENT DOCUMENTS

| | | | |
|---|---|---|---|
| 0 469 854 | 2/1992 | European Pat. Off. . | |
| 0 540 245 | 5/1993 | European Pat. Off. . | |
| 0 622 237 | 11/1994 | European Pat. Off. . | |
| 0 630 750 | 12/1994 | European Pat. Off. . | |
| 40 15 799 | 11/1991 | Germany . | |
| 54-56847 | 5/1979 | Japan . | |
| 59-1233670 | 7/1984 | Japan . | |
| 59-138461 | 8/1984 | Japan . | |
| 60-71260 | 4/1985 | Japan . | |
| 401186336A | 7/1989 | Japan | 347/188 |
| 401186342A | 7/1989 | Japan | 347/188 |
| 404090365A | 3/1992 | Japan | 347/188 |
| 404163062A | 6/1992 | Japan | 347/188 |
| 405004369A | 1/1993 | Japan | 347/188 |
| 5-92565 | 4/1993 | Japan . | |
| 406008498A | 1/1994 | Japan | 347/188 |

*Primary Examiner*—Eugene Eickholt
*Attorney, Agent, or Firm*—Fitzpatrick, Cella, Harper & Scinto

[57] ABSTRACT

A printing apparatus and a printing registration method permits printing registration between a forward and a reverse scan of a head cartridge between a plurality of head cartridges without troubling a user and simply. By forward and reverse scan of the head cartridge, a plurality of patterns, in which a print start timing of the reverse scan is shifted per a predetermined amount relative to that of the forward scan, are printed. These patterns may vary an area factor by the dots formed by printing depending upon offset amount. On the other hand, the plurality of patterns are optically read an average density. By this, the timing, at which the read average density is maximum is set as the printing registration condition.

44 Claims, 32 Drawing Sheets

PRINTING APPARATUS AND PRINTING REGISTRATION METHOD

This application is based on Patent Applications No. 86,611/1997 filed Apr. 4, 1997 in Japan and No. 91,475/1998 filed Apr. 3, 1998 in Japan, the content of which is incorporated hereinto by reference.

BACKGROUND OF THE INVENTION

1. Field of the Invention

The present invention relates generally to a printing apparatus and a printing registration method. More particularly, the invention relates to a technology for enhancing printing registration upon a bidirectional printing performing printing during a forward scan and a reverse scan of a printing head or upon printing employing a plurality of printing heads.

2. Description of the Related Art

Conventionally, printing registration of this kind is generally performed in the following manner.

For example, upon printing registration in a forward scan and a reverse scan upon performing bidirectional or reciprocal printing, a relative printing registration condition for bidirectional scan is varied by adjusting respective printing timing in the forward scan and the reverse scan to perform printing ruled lines on a printing medium by performing the bidirectional scan in respective conditions. Then, a result of printing is observed by a user or the like to select the printing condition where best printing registration is achieved and to set the printing condition concerning printing registration in a printing apparatus, a host computer or the like.

In printing registration between heads when a plurality of printing heads are employed, the ruled lines are printed by respective heads with varying the relative printing registration condition to select the printing registration condition where the best printing registration is attained, by the user or the like, similarly to the above, to set the selected printing registration condition in the printing apparatus, the host computer or the like.

However, in such conventional printing registration method, it is required to select the printing registration condition with observing the result by the user or the like and to perform an operation for setting the printing registration condition to make the operation troublesome. Certain users, for whom such troublesome operation is unfavorable, do not perform printing registration to use a printing apparatus in a condition containing printing position offset or printing registration error in respective scan of bidirectional printing or between heads.

Furthermore, in the conventional method, printing position can be selected only among respective printing registration conditions of the printed patterns. For further printing registration with higher precision, it becomes necessary to perform printing of greater number of patterns with slightly varying the printing and to distinguish delicate difference among the printed patterns by the user, and to select the printing registration condition. In addition to trouble of the user, it takes a long period in printing registration and require large number of patterns on the printing medium.

SUMMARY OF THE INVENTION

The present invention has been worked out for solving the foregoing problems in the prior art. Therefore, it is an object of the present invention to provide a printing apparatus and a printing registration method which permits printing registration without troubling a user.

Another object of the present invention is to provide a method of an optimal printing registration irrespective of the ink to be used.

According to the first aspect of the present invention, a printing apparatus performing printing on a printing medium by using a print head, comprises:

control means for controlling the print head for forming a plurality of patterns respectively having optical characteristics corresponding to a plurality of offset amounts, which plurality of patterns being patterns formed by a first printing and a second printing to be registered, and the plurality of patterns being formed corresponding to a plurality of offset amounts of relative printing positions of the first print and the second print;

optical characteristics measuring means for measuring optical characteristics of respective of a plurality of patterns formed by the control means; and printing registration means for performing printing registration process of the first print and the second print on the basis of respective optical characteristics of a plurality of patterns measured by the optical characteristics measuring means.

In the printing apparatus, wherein the first printing and the second printing may be a print in a forward scan and a print in a reverse scan upon performing printing by bidirectionally scanning the print head on the printing medium.

In the printing apparatus, wherein the first print and the second print may be a print by a first print head and a print by a second print head among a plurality of print heads, and the control means forms a pattern concerning an offset amount in a direction relatively scanning the first and second print head with respect to the printing medium.

In the printing apparatus, wherein the control means may form patterns at a pitch wider than a pitch of the printing position which the printing apparatus can be controlled.

In the printing apparatus, wherein the printing registration means may derive a printing registration condition adapted to the printing position by calculation employing sequential values on the basis of optical characteristics data obtained by the optical characteristics measuring means.

In the printing apparatus, wherein the printing registration means may derive a printing registration condition adapted to the printing position by calculation using a linear approximation or a polynomial approximation.

In the printing apparatus, wherein the printing registration means may include means for deriving a printing registration condition including a printing position parameter more precise than the printing registration condition or a printing position parameter different from the printing registration condition.

In the printing apparatus, wherein the first print and the second print may be a print printed by a first print head and a print printed by a second print head, and the control means forms pattern concerning the offset amount in a direction different from a direction of relative scan of the first and second print head with respect to the printing medium.

In the printing apparatus, wherein the control means may arrange dots formed by the first print and dots formed by the second print, relative positional relationship of the dots is varied corresponding to the plurality of offset amounts for varying a ratio of the dots covering the printing medium for forming a plurality of patterns representative of optical characteristics depending upon the offset amounts.

In the printing apparatus, wherein the control means may form a pattern reducing density of the optical characteristics according to increasing of offset amount in the plurality of patterns.

In the printing apparatus, wherein the control means may set a rate of coverage of the printing medium by the dots to be approximately 100% at the maximum.

In the printing apparatus, wherein when the rate may be approximately 100%, the control means may arrange the dots formed by the first print and the dots formed by the second prints within a range from a distance where respective dots contacts with each other at least to a distance equal to a radius of one of the dots.

In the printing apparatus, wherein the control means may form a pattern increasing a density as the optical characteristics according to increasing of offset amount in a plurality of patterns.

In the printing apparatus, wherein the optical characteristics measuring means may measure respective average optical characteristics of a plurality of patterns.

In the printing apparatus, wherein the optical characteristics measuring means may measure the optical characteristics by the optical sensor and a measuring spot of the optical sensor is set to be wider than the dots of the pattern.

In the printing apparatus, wherein the optical characteristics measuring means may have an optical sensor of a lower resolution than resolution of dots printed by the control means.

In the printing apparatus, wherein the optical characteristics measuring means may measure the optical characteristics by the optical sensor, and an average of the optical characteristics measured by scanning the optical sensor on the pattern may be taken as optical characteristics of a plurality of patterns.

In the printing apparatus, wherein the printing registration means may derive a sequential density distribution on the basis of density as respective optical characteristics measured with respect to a plurality of the patterns and may set a condition corresponding to the maximum value of the sequential density distribution as an optimal printing registration condition.

In the printing apparatus, wherein the printing registration means may set a condition of offset amount corresponding to the maximum density among density as respective optical characteristics measured with respect to the plurality of patterns, as an optimal printing registration condition.

In the printing apparatus, wherein the printing registration means may derive a sequential density distribution on the basis of density as respective optical characteristics measured with respect to a plurality of patterns and may set a condition corresponding to the minimum value of the sequential density distribution as an optimal printing registration condition.

In the printing apparatus, wherein the printing registration means may set a condition of offset amount corresponding to the minimum optical characteristics among optical characteristics as respective optical characteristics measured with respect to the plurality of patterns, as an optimal printing registration condition.

Here, the printing apparatus may further comprise optical characteristics modifying means for making judgement whether the optical characteristics measured by the optical characteristics measuring means is sufficient for processing printing registration by the printing registration means, and modifying the optical characteristics of the pattern formed by the control means on the basis of the judgment.

Here, the printing apparatus may further comprise pattern modifying means for making judgment whether the density as a plurality of optical characteristics measured by the optical characteristics measuring means is decreased or increased according to increasing of the offset amount in an extent enabling printing registration process by the printing registration means, and modifying the plurality of patterns to be formed by the control means on the basis of the judgment.

In the printing apparatus, wherein the print head may be for performing printing by ejecting an ink and has a thermal energy generating body generating a thermal energy to be used for ink ejection.

Here, in the printing apparatus, control means may further comprise optical ejection duty judgement means for printing a plurality of patterns with varying ejection duty in a predetermined patch, shifting either one or both of the carriage and the printing medium so that the optical sensor mounted on the carriage and the pattern to be the print become a corresponding position, measuring the optical reflection index with respect to the ejection duty of the patch, deriving a region where the optical reflection index with respect to the ejection duty becomes large rate of change from distribution of the measured optical reflection index, and deriving an optimal ejection duty at which the optical reflection index is maximum in the region.

In the printing apparatus, wherein the maximum ejection duty judgement means may modify print of printing registration pattern to be printed next on the basis of the optimal ejection duty derived by the optimal ejection duty judgment means.

In the printing apparatus, when the printing registration means may perform printing registration for the forward scan and the reverse scan, a first pattern used for the print in the forward scan and a second pattern used for the printing in the reverse scan are pattern increasing the optical reflection index according to increasing of offset of printing position of the first and second patterns.

In the printing apparatus, wherein the printing registration means may print a first pattern to be used for the print in the forward scan and a second pattern to be used for the print in the reverse scan, shifts either or both of the carriage and the printing medium for placing the optical sensor mounting on the carriage and the pattern to be printed at corresponding positions, measures the optical reflection index of respective patches, derives the ejection duty, at which the variation amount of the optical reflection index becomes maximum, and derives the optimal printing registration condition at the derived ejection duty, when printing registration is performed for the forward scan and the reverse scan.

Here, in the printing apparatus, wherein the control means may further comprise optimal ejection duty judgement means for printing a plurality of patterns varying ejection duty within a predetermined patches per each of a plurality of print heads, shifting either or both of the carriage and the printing medium for placing the optical sensor mounting on the carriage and the pattern to be printed at corresponding positions, measuring the optical reflection index with respect to the ejection duty of the patch, deriving a region where the optical reflection index with respect to the ejection duty becomes large rate of change from distribution of the measured optical reflection index, and deriving an optimal ejection duty at which the optical reflection index is maximum in the region.

In the printing apparatus, wherein the optimal ejection duty judgment means may modify print of printing registration pattern to be printed next per each head on the basis of the derived optimal ejection duty per each head.

In the printing apparatus, wherein the printing registration means may print the first pattern and the second pattern varying the ejection rate and the printing position, shifts either or both of the carriage and the printing medium to place the optical sensor mounted on the carriage and the printed pattern being in the corresponding positions, derives the ejection duty where the variation amount of the optical reflection index is maximum, and derives the optimal printing registration condition on the basis of ejection duty, when printing registration between the print heads in the scanning direction is established using a plurality of print heads.

In the printing apparatus, wherein the printing registration means may print the first pattern and the second pattern varying the ejection rate and the printing position, shifts either or both of the carriage and the printing medium to place the optical sensor mounted on the carriage and the printed pattern being in the corresponding positions, measures the optical reflection index of respective patches, derives the ejection duty where the variation amount of the optical reflection index is maximum, and derives the optimal printing registration condition on the basis of ejection duty, when printing registration between the print heads in the a direction perpendicular to the scanning direction is established using a plurality of print heads.

According to the second aspect of the present invention, a printing apparatus performing printing on a printing medium using a print head, when a pattern is formed by a first print and a second print to be registered and the patterns of the prints are performed by inks of different color development, the apparatus comprises:

control means for printing a predetermined patterns by using an ink of relatively low density for any one of the first print and the second print, and ejecting relatively large amount of ink for print of the ink of relatively low density on the printing medium;

printing registration condition selecting means for providing information of the printing position to the printing apparatus; and printing registration means performing printing registration process of the first print and the second print on the basis of the information provided by the printing registration condition selecting means.

In the printing apparatus, wherein the first print and the second print may be a print by a first print head and a print by a second print head among a plurality of print heads, and the control means may form a pattern concerning an offset amount in a direction relatively scanning the first and second print head with respect to the printing medium.

In the printing apparatus, wherein the first printing and the second printing may be a print in a forward scan and a print in a reverse scan upon performing printing by bidirectionally scanning the print head on the printing medium.

In the printing apparatus, wherein the printing registration condition selecting means may permit the user to select the printing registration condition on the basis of the result of printing of the pattern and inputs the condition to the printing apparatus.

In the printing apparatus, wherein the control means may form a plurality of patterns respectively formed corresponding to a plurality of offset amounts of relative printing positions in the first print and the second print and representing respective optical characteristics corresponding to the offset amount, the printing registration condition selecting means may measure the optical characteristics of a plurality of patterns formed by the control means and selecting printing registration condition on the basis of the result of measurement.

In the printing apparatus, wherein the printing registration condition selecting means preliminarily may provide information to be used by the print head in the print head and relatively varies the ejecting ink amount on the basis of the information.

In the printing apparatus, wherein the control means may include means for varying deposition amounts of the first print and the second print on the basis of the ink amount varied by the printing registration condition selecting means.

In the printing apparatus, wherein the means for varying the deposition amount may eject the ink having lower density in relatively large amount by varying a driving control pulse of the print head.

In the printing apparatus, wherein the means for varying the deposition amount may eject the ink having lower density in relatively large amount by varying an energy applied to the print head.

In the printing apparatus, wherein the means for varying deposition amount ejecting the ink may vary a holding temperature of the head and varies the ink deposition amount.

In the printing apparatus, wherein means for varying the deposition amount may eject the ink for a plurality of times for the same pixel.

According to the third aspect of the present invention, a printing method for performing printing registration of a printing apparatus which performs printing on a printing medium by a printing by the print head, comprises the steps of:

forming a plurality of patterns which are patterns formed by the first print and the second print for establish printing registration, respectively formed by corresponding to a plurality of offset amounts of relative printing positions between the first print and the second print;

measuring respective optical characteristics of a plurality of patterns formed; and performing printing registration process of the first print and the second print on the basis of the optical characteristics of respective of a plurality of the measured patterns.

Another aspect of printing registration method according to the present invention is to performing printing of the pattern varying density depending upon the printing registration condition and to obtain a multi-value level density data by the optical sensor. Also, using the data thus obtained, concerning the pitch of the more precise printing registration condition, higher resolution, or greater number of position condition in comparison with a plurality of kinds of the printing registration condition of the printing pattern or the printing registration condition not used in the printing pattern, the optimal printing registration condition is derived by numerical computation. By using the result thereof, it becomes possible to select the printing registration condition from the pitch of the more precise printing registration condition, higher resolution, or greater number of position condition in comparison with a plurality of kinds of the printing registration condition of the printing pattern or the printing registration condition not used in the printing pattern. By this, printing registration condition can be selected at higher precision that the printing registration condition used in the printing pattern.

Furthermore, in order to establish printing registration at high precision, the user is held free from a trouble in selecting the printing registration condition from delicately different printing patterns.

Also, since printing registration can be established at higher precision with smaller number of the printing patterns, the patterns required for printing registration can be reduced to shorten a period required for printing registration for smaller number of patterns to be checked.

A further aspect of printing registration method according to the present invention is to print the patterns (patches), in which the density resulting from printing becomes the highest as printed at the optimal printing position, are printed with varying ejection duty and the printing registration condition when printing registration is to be established for printing of the first print and the second print. The densities of the printed patterns are read by the optical sensor mounted on the carriage to derive relative relationship of the optical reflection index by printing registration. By this, optimal printing registration can be established with reducing influence by bleeding. Furthermore, by preliminarily printing the uniform pattern with varying the ejection duty to derive the ejection duty where the amount of the variation of the measured optical reflection index maximum to perform printing registration at the derived ejection duty.

With the construction set forth above, by performing printing of the printing registration patterns with varying the deposition amount to enable printing registration on the basis of the information obtained from the printed pattern. By this, even for printing registration for the combination of the high and low density inks which has been considered to be difficult in the prior art, for permitting ejection of relatively large amount of ink having the relatively low density to enable further optimal printing registration.

Furthermore, with the construction set forth above, a plurality of patterns representative of the offset amount are formed corresponding to a plurality of offset amount of the printing position to perform printing registration process on the basis of a plurality of the densities measured with respect to these patterns. Therefore, the condition of the highest density or the lowest density among the densities represented by the patterns can be set as the best registered condition. should be noted that throughout the disclosure and claims the word "print" represents not only forming of significant information, such as characters, graphic image and so on but also represent to form image, pattern and the like on the printing medium irrespective whether it is significant or not and whether the formed image elicited to be visually perceptible or not, in broad sense, and further includes the case where the medium is processed.

Here, the wording "printing medium" represents not only paper to be typically used in the printing apparatus but also cloth, plastic film, metal plate and the like and any substance which can accept the ink, in broad sense.

Furthermore, the wording "ink" has to be understood in broad sense similarly to the definition of "print" and should include any liquid to be used for formation of image, pattern and the like or for processing of the printing medium.

Throughout the disclosure and claims, as the optical characteristic, optical density, namely reflection optical density using reflection index and transmission optical density using transmittance, is used. But, optical reflection index, intensity of reflection light or the like may be used. In the following disclosure and claims, the reflection optical density is mainly used as the optical characteristic and is abbreviated to optical density or simply density unless there is no confusion.

The above and other objects, effects, features and advantages of the present invention will become more apparent from the following description of the embodiments thereof taking in conjunction with the accompanying drawings.

BRIEF DESCRIPTION OF THE DRAWINGS

FIG. 6A shows a case where the printing positions are well registered. FIG. 6B shows a case where the printing positions are registered with a slight offset. FIG. 6C shows a case where the printing positions are registered with a greater offset;

FIG. 7A shows a case where the printing positions are well registered. FIG. 7B shows a case where the printing positions are registered with a slight offset. FIG. 7C shows a case where the printing positions are registered with a greater offset;

FIG. 13A shows a case where the printing positions are well registered. FIG. 13B shows a case where the printing positions are registered with a slight offset. FIG. 13C shows a case where the printing positions are registered with a greater offset;

FIG. 14A shows a case where the printing positions are well registered. FIG. 14B shows a case where the printing positions are registered with a slight offset. FIG. 14C shows a case where the printing positions are registered with a greater offset;

FIG. 15A shows a case where the printing positions are well registered. FIG. 15B shows a case where the printing positions are registered with a slight offset. FIG. 15C shows a case where the printing positions are registered with a greater offset;

FIG. 16A shows a case where the printing positions are well registered. FIG. 16B shows a case where the printing positions are registered with a slight offset. FIG. 16C shows a case where the printing positions are registered with a greater offset;

FIG. 18A shows a case where the printing positions are well registered. FIG. 18B shows a case where the printing positions are registered with a slight offset. FIG. 18C shows a case where the printing positions are registered with a greater offset;

FIG. 19A shows a case where the printing positions are well registered. FIG. 19B shows a case where the printing positions are registered with a slight offset. FIG. 19C shows a case where the printing positions are registered with a greater offset;

FIG. 21A shows a case where the printing positions are well registered. FIG. 21B shows a case where the printing positions are registered with a slight offset. FIG. 21C shows a case where the printing positions are registered with a greater offset;

FIG. 23A shows a result of print at 25% of the area factor. FIGS. 23B to 23C show results of print at 50%, 75% and 100% of the area factor, respectively;

FIG. 25A shows a case where the printing positions are well registered. FIG. 25B shows a case where the printing positions are registered with a slight offset. FIG. 25C shows a case where the printing positions are registered with a greater offset;

FIGS. 26A to 26D show results of print at 25%, 50%, 75% and 100% of ejection duty, respectively;

FIG. 29A shows a case where the printing positions are well registered. FIG. 29B shows a case where the printing positions are registered with a slight offset. FIG. 29C shows a case where the printing positions are registered with a greater offset;

FIG. 30A shows a single pulse and FIG. 30B shows double pulses;

DETAILED DESCRIPTION OF PREFERRED EMBODIMENTS

Figure 1:
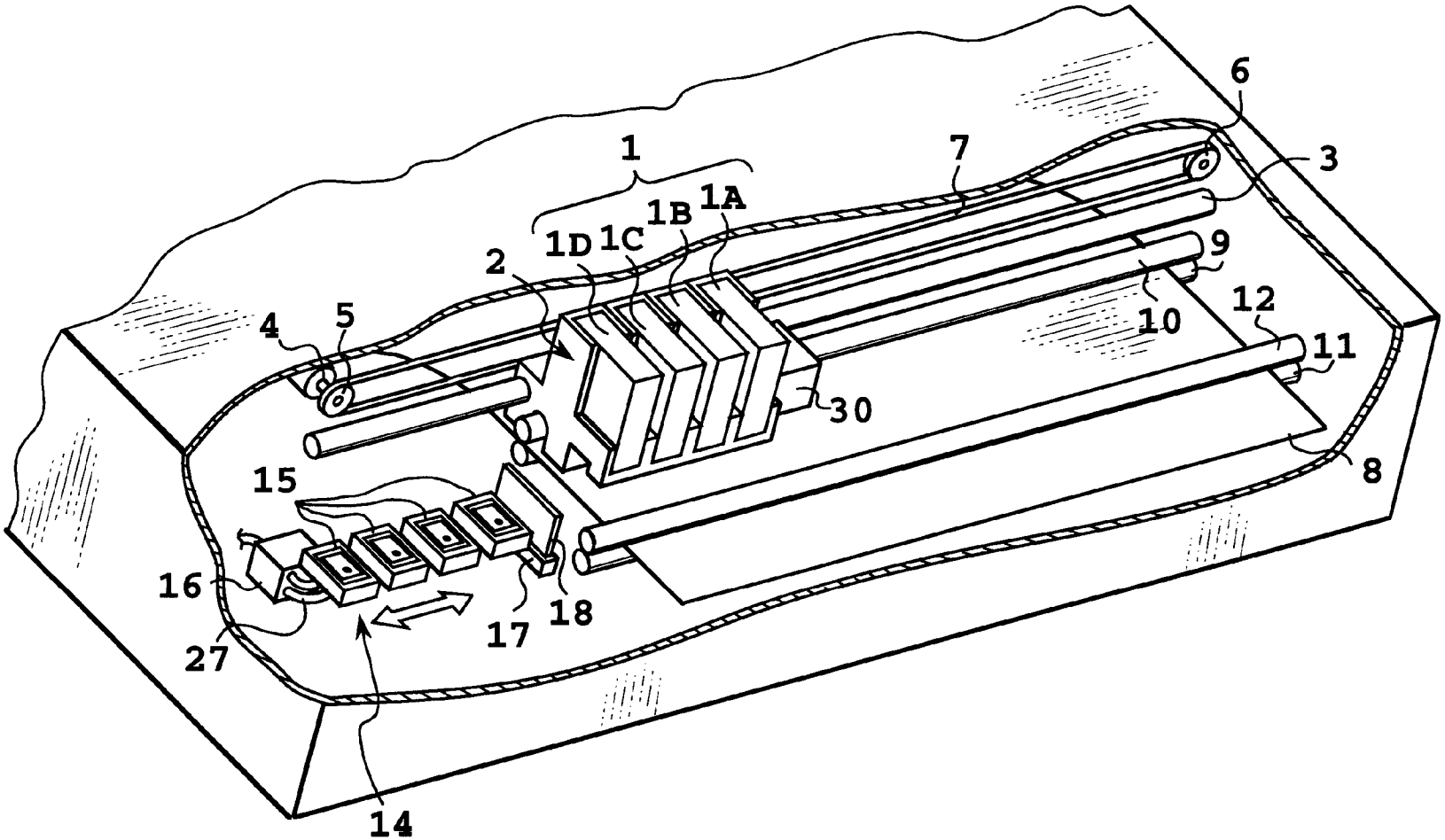
FIG. 1 is a partially cut out perspective view showing a general construction of one embodiment of an ink-jet printing apparatus according to the present invention.

In a printing registration method and a printing apparatus according to one embodiment of the present invention, printing in a forward scan and in a reverse scan or printing by respective of a plurality of printing heads (hereinafter referred to "first printing" and "second printing") are to be performed at the same position on a printing medium. Also, by varying conditions determining relative position between the first printing and the second printing, printing is performed under a plurality of mutually distinct conditions. Then, by an optical sensor having a lower resolution than a resolution of the print, density of respective prints are read to derive a best printing registration condition by reading a density of respective print and on the basis of a relative relationship between those density values. Computation to be performed at this time is variable depending upon the pattern to be printed.

In one embodiment of the present invention, a printing head is scanned in a forward and a reverse directions with respect to a printing medium for printing. In a printing registration for the forward scan and the reverse scan by a serial printer forming an image, the first printing pattern to be used for printing in the forward scan and the second printing pattern to be used for printing in the reverse scan, for printing registration, are as follows.

Upon performing bidirectional printing under an ideal printing registration condition, a distance in a carriage scanning direction between a printing dot to be formed in the forward scan and a printing dot to be formed in the reverse scan is preferably in a range of one half to one time of a dot diameter. In a printing pattern, an average density in a printing portion is reduced according to increase of offset or difference in relative positions. By using the pattern, whether the printing positions are consistent or not can be reflected in the average density of the portion of the print ("printing portion"). Thus, a printing registration condition can be determined by measuring the density with an optical sensor mounted on a carriage and by calculation based thereon. As a calculation method, a predetermined calculation is performed on the basis of a density distribution with respect to a plurality of printing registration conditions to determine the condition where the best printing registration is attained. It should be noted that when high precision is not required in printing registration and more simplified computation is desired, a printing condition where the highest density data is obtained, may be selected as the printing registration condition, for example.

Printing patterns in other embodiments are as follows. When printing of the first pattern to be used for printing in the forward scan and the second pattern to be used for printing in the reverse scan is performed under the ideal printing registration condition, the printed dots respectively printed become the most overlapped condition. According to increase of difference in the printing registration condition, printing registration offset in overlapping dots is increased to increase the average density in the printing portion. By using the pattern, whether the printing positions are consistent or not can be reflected in the average density of the printing portion. Thus, a printing registration condition can be determined by measuring the density with the optical sensor mounted on a carriage and by calculation based thereon. As a calculation method, a predetermined calculation is performed on the basis of a density distribution with respect to a plurality of printing registration conditions to determine the condition where the best printing registration is attained. It should be noted that when more simplified computation is desired, a printing condition where the lowest density data is obtained, may be selected as the printing registration condition in the embodiment.

In the foregoing two embodiments, in order to perform printing registration at high precision in bidirectional printing, it is desirable that the density of the printing portion on the printing medium is significantly varied corresponding to difference of printing registration conditions. For this purpose, it is required that the distance between the printing dots in the carriage scanning direction of the printing patterns in the forward scan and the reverse scan is an appropriate distance with respect to the diameter of the dots. On the other hand, in case of an ink-jet type printing apparatus, for example, the dot diameter is varied according to a characteristics of the printing medium, a kind of an ink, a volume of an ink droplet to be ejected from the printing head. Therefore, in advance of pattern printing for printing registration, a plurality of predetermined pattern is printed with varying distances between dots in the carriage scanning direction, the optical densities of the printed patterns are read to detect the dot diameters for adjusting the distance between the dots in pattern printing for printing registration. By this, an appropriate printing registration can be established irrespective of the kind of the printing medium or the ink, size of the ink droplet and so on.

In order to perform printing registration in the bidirectional printing with high precision, it is desirable that the output of the optical sensor has sufficient gradation levels. For this purpose, it is necessary that the density of the printing portion for the printing registration falls within a predetermined range. For example, when printing is performed by a black ink on a printing medium having a high color development characteristics, black in the printing portion becomes excessively strong to make absolute amount of the reflected light too small to obtain sufficient output of the optical sensor. In advance of pattern printing for printing registration, a plurality of predetermined patterns are printed and optical density is read. On the basis of the result, the color development characteristics at that time is evaluated. Thinning or overlapping printing is performed in the printing pattern for printing registration on the basis of evaluation for adjustment of density.

As a further embodiment of the present invention, the present invention is applicable for a serial printer employing a plurality of printing heads, and scanning those printing heads with respect to the printing medium for forming an image. In this case, concerning printing registration in the carriage scanning direction between the heads, in place of printing in the forward scan and printing in the reverse scan, as relative printing registration of printing by a first head and printing by a second head, printing registration in bidirectional printing can be implemented similarly.

On the other hand, also for printing registration in the case where a plurality of printing heads are arranged in the direction vertical to the carriage scanning direction, in place of printing in the forward scan and printing in the reverse scan, printing by the first head and printing by the second head arranged in the vertical direction are performed to perform printing registration similarly to the case of foregoing printing registration in bidirectional printing.

Furthermore, even in so-called a full-line type printing apparatus, in which the printing heads are fixed on the printing apparatus and only feeding of the printing medium is performed, printing registration in the similar manner can be performed, as a matter of course.

The present invention is further applicable for the case where printing is performed with employing the ink or the printing medium which easily causes bleeding. A uniform pattern is printed on the printing medium in plurality times with varying deposition amount, the optical reflection indexes are measured by the sensor on the carriage to derive an deposition amount region where variation amount of the optical reflection indexes is the largest. Within thus derived region of the ink ejection amount, patterns for printing registration is printed with varying its relative printing position. After measuring the optical reflection index, by deriving the best reflection index, for example, when the reflection index becomes larger as the offset of the printing position becomes lager, by deriving the lowest reflection index, an optimal printing registration position can be selected.

On the other hand, the patterns are printed on the printing medium with varying the deposition amounts and the printing positions. Among the printed patterns, the deposition amount where the variation amount of the optical reflection index is the largest, is derived and a position where the optical reflection index becomes smallest as varying the printing registration, at the derived deposition amount, may be derived to derive the optimal printing registration position.

Next, concerning printing registration in the case where a plurality of colors of inks are employed in the first head and the second head, when the inks to be used are different kinds, bleeding conditions in the printing by the first head and in the printing by the second head can be different due to compositions of the inks. For example, when printing is performed with the printing medium which easily causes bleeding, such as plain paper, bleeding is caused between the dots even when printing positions are varied to make it difficult to select at least the optimal printing position since the adjacent dots becomes continuous to make variation of density too small.

The uniform pattern is printed on the printing medium with the ink of the first head used by the printing registration pattern for a plurality of times. Then, densities of the printed patterns are measured to derive the deposition amount region where the variation amount of the optical reflection index becomes large. Similarly, with the ink of the second head to be used in the printing registration pattern, the deposition amount region where the variation amount of the optical reflection index becomes largest, is derived. The patterns for printing registration in the optimal deposition amount region by the first and the second heads, are printed by varying the printing positions. Printing registration in the case where a plurality of colors of inks are used, can be performed with employing transparent ink which varies density when overlapping printing is performed with colored inks.

The patterns are printed on the printing medium with varying the deposition amounts of the first and the second heads and the printing positions. Among the printed patterns, the deposition amount where the variation amount of the optical reflection index becomes largest and the position where the optical reflection index is the smallest as varying the printing registration position, at the derived deposition amount, to derive the optimal printing registration position.

Similarly, concerning printing registration between the printing heads in the direction different from the carriage scanning direction, for example, in the vertical direction between the printing heads of a serial printer which has a plurality of printing heads and forms an image by performing scanning of those printing heads with respect to the printing medium, in place of printing in the forward scan and the reverse scan, printing by the first head and printing by the second head are performed. Similarly to the case of printing registration in the bidirectional printing, the pattern to be used for printing registration is the one, in which vertical and horizontal in the bidirectional printing are reversed.

Upon establishing the optimal printing registration, even in automatic printing registration or in the manual printing registration by the user, it is important that the results of the first print and the second print on the printing medium exceeds a predetermined density. Namely, it is important to vary the ink deposition amount depending upon the higher density ink or the lower density ink. By performing this, the predetermined density can be obtained to permit optimal printing registration. Then density of the printing portion is variable depends on the property of the printing medium, the kind of the ink, the volume of the ink droplet to be ejected from the printing head toward the printing medium and the like. Accordingly, in order to establish printing registration for printing by a plurality of heads with high precision, with respect to variation of the printing registration condition between the heads, it is desirable to significantly vary the density of the printing portion.

Therefore, it is preferable that a plurality of heads thus established the printing registration, the density of respective printing portion are substantially equal levels. However, when printing of the printing registration pattern is performed with the ink having high ink as the high density ink and the low density ink, the relative difference of the density of the printing portion between the heads becomes significant. Namely, even by varying the relative printing position between the heads, the printing result by the high density ink becomes dominant to make it impossible to obtain density variation necessary for judgment of printing registration to cause difficulty in selecting the optimal printing position.

Therefore, before printing the printing registration pattern in the printing medium, the uniform pattern is printed in plurality of times with varying the ink deposition amount to measure the density of the printed pattern by the sensor on the carriage. Then, the ink ejection condition where the density variation rate is the best suited is derived. The printing registration pattern is printed with varying the printing position in the region of the ink ejection condition. Then, density is measured, the condition where the density is highest, is derived to permit selection of the optimal printing position.

The ink loaded, the ink amount to be required for performing printing registration by the head in question and so on are preliminarily stored in the printing head. Under such condition, the printing registration pattern is printed with varying the printing position to derive the condition where the density is the highest to enable derivation of the optimal printing position.

Concerning printing registration in the case where a plurality of colors, difference of sensitivity of the sensor should be caused depending upon the combination of the inks, the printing medium and sensitivity of the sensor to be used for reflection density.

Therefore, in advance of printing of the printing registration pattern in the printing medium, uniform pattern for respective color image is printed for a plurality of times with varying the ejection amount, the deposition amount and number of ejection. Then, the densities of the patterns thus printed are measured by the sensor mounted on the carriage to select two colors of the best suited density variation. By performing printing of the printing registration patterns with these two colors to derive the condition where the density is the highest to establish optimal printing registration.

With the combination of all colors uniform pattern for respective color image is printed for a plurality of times with varying the ejection amount, the deposition amount and number of ejection. Then, the densities of the patterns thus printed are measured by the sensor mounted on the carriage to be derived the combination where the variation amount of the density is the largest. Then, the density is measured and the condition where the largest density is obtained is derived to select the optimal printing position.

In printing registration of the case where a plurality of colors of inks are used, it is not limited to the colored inks, but can be a transparent ink which can vary density by causing dilution or variation of composition when overlaid with the colored ink, for example.

As other embodiment of the present invention, in a serial printer having a plurality of printing heads and forms the image by scanning the printing head with respect to the printing medium, the present invention is applicable even for the case where printing registration is performed without using the optical sensor and by visually by each user. When printing registration is performed in the direction the carriage scanning direction between the heads, in place of the foregoing printing pattern, rules lines indicative of variation of the relative positional relationship of the first print and the second print is printed. Upon performing printing of the ruled line, depending upon density of the inks of respective heads to be registered, ink ejecting conditions are varied. By varying of the ink deposition amount, optimal printing registration condition can be selected.

Concerning the printing registration in the direction perpendicular to the carriage scanning direction, the present invention can be implemented by using the printing pattern used in the foregoing two embodiments where the longitudinal and lateral are reversed. Similarly to the foregoing embodiment, in the serial printer which forms image by scanning a plurality of printing heads on the printing medium, printing registration can be performed by performing printing by the first head and the second head printing registration in the bidirectional printing can be similarly performed with respect to any of the foregoing embodiment by employing the first print and the second print.

Particular embodiments of the present invention will be explained hereinafter with reference to the drawings. It should be noted that like reference numerals represent like elements.

First Embodiment

The first embodiment of the present invention is adapted for mutual printing registration of the printing position in the forward scan and the printing position in the reverse scan, in a printing system forming an image by performing complementary printing in the forward scan and the reverse scan by means of one printing head. It should be noted that, in this example, a case where one kind of printing medium is used, will be explained.

(Construction of Printing Apparatus 1)

FIG. 1 is a diagrammatic perspective view showing a construction of a major part of one embodiment of an ink-jet printing apparatus, to which the present invention is applied.

In FIG. 1, a plurality of (four) head cartridges 1A, 1B, 1C and 1D are exchangeably mounted on a carriage 2. Each of the head cartridges 1A to 1D has a printing head portion and an ink tank portion, and also has a connector for exchanging a signal for driving the printing head portion. It should be noted that, in the following explanation, both of overall or arbitrary one of head cartridges 1A to 1D as generally referred to are simply identified as a printing head 1 or head cartridge 1.

A plurality of head cartridges 1 are adapted to perform printing with respectively different colors of inks. In the ink tank portions thereof, different inks, such as black, cyan, magenta and yellow color inks, are stored. Each head cartridge 1 is exchangeably mounted on the carriage 2 in a positioned condition. To the carriage 2, a connector holder (electrical connecting portion) is provided for transmitting a drive signal or the like to each head cartridge 1 via the connector.

The carriage 2 is guided and supported by a guide shaft 3 extending in a primary scanning direction within an apparatus body for bidirectionally movement along the guide shaft 3. The carriage 2 is driven by means of a primary scanning motor 4 via a driving mechanism, such as a motor pulley 5, a driven pulley, a timing belt 7 and so forth, and is thereby controlled the position and motion. A printing medium 8, such as a printing paper, a plastic thin film or the like is fed (paper feeding) across a position opposing to ejection opening surface of the head cartridge 1 (printing portion), by rotation of two sets of transporting rollers 9, 10 and 11, 12. It should be noted that the printing medium 8 is supported the back surface thereof by a platen (not shown) so as to form a flat printing surface in the printing portion. In this case, each head cartridge 1 mounted on the carriage 2 is held with projecting the ejection opening surface downwardly from the carriage 2 in parallel relationship with the printing medium 8 at a position between two sets of the transporting roller pairs. Also, a reflection type optical sensor 30 is provided on the carriage.

The head cartridge 1 is an ink-jet head cartridge ejecting an ink utilizing a thermal energy, in which an electrothermal transducer is provided for generating a thermal energy. Namely, the head cartridge of the head cartridge 1 performs printing by ejecting the ink through the ejection openings using a pressure of a bubble generated by film boiling caused by the terminal energy applied by the electrothermal transducer.

(Construction of Printing Apparatus 2)

Figure 2:
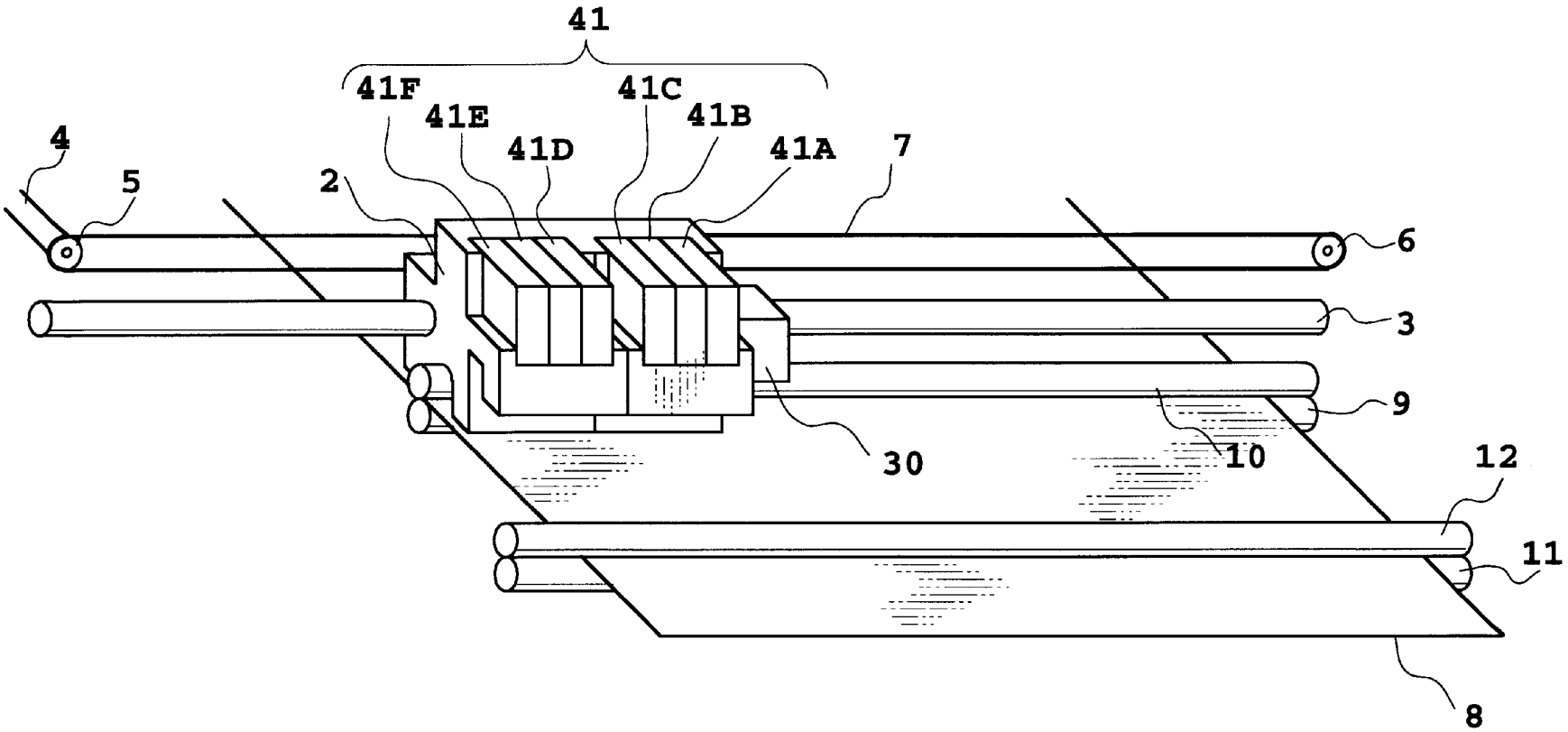
FIG. 2 is a partially cut out perspective view showing a general construction of another embodiment of an ink-jet printing apparatus according to the present invention.

FIG. 2 is a diagrammatic perspective view showing a construction of a major part of one embodiment of an ink-jet printing apparatus, to which the present invention is applied. In FIG. 2, the portions of the same reference numerals as shown in FIG. 1 have the same functions, so descriptions for them are abbreviated.

In FIG. 2, a plurality of (six) head cartridges 41A, 41B, 41C, 41D, 41E and 41F are exchangeably mounted on a carriage 2. Each of the head cartridges 41A to 41F has a head cartridge portion and an ink tank portion, and also has a connector for exchanging a signal for driving the head cartridge portion. It should be noted that, in the following explanation, both of overall or arbitrary one of head cartridges 41A to 41F as generally referred to are simply identified as a head cartridge 41 or head cartridge 41. A plurality of head cartridges 41 are adapted to perform printing with respectively different colors of inks. In the ink tank portions thereof, different inks, such as black, cyan, magenta, yellow, low density cyan and low density magenda are stored. Each head cartridge 41 is exchangeably mounted on the carriage 2 in a positioned condition. To the carriage 2, a connector holder (electrical connecting portion) is provided for transmitting a drive signal or the like to each head cartridge 41 via the connector.

Figure 3:
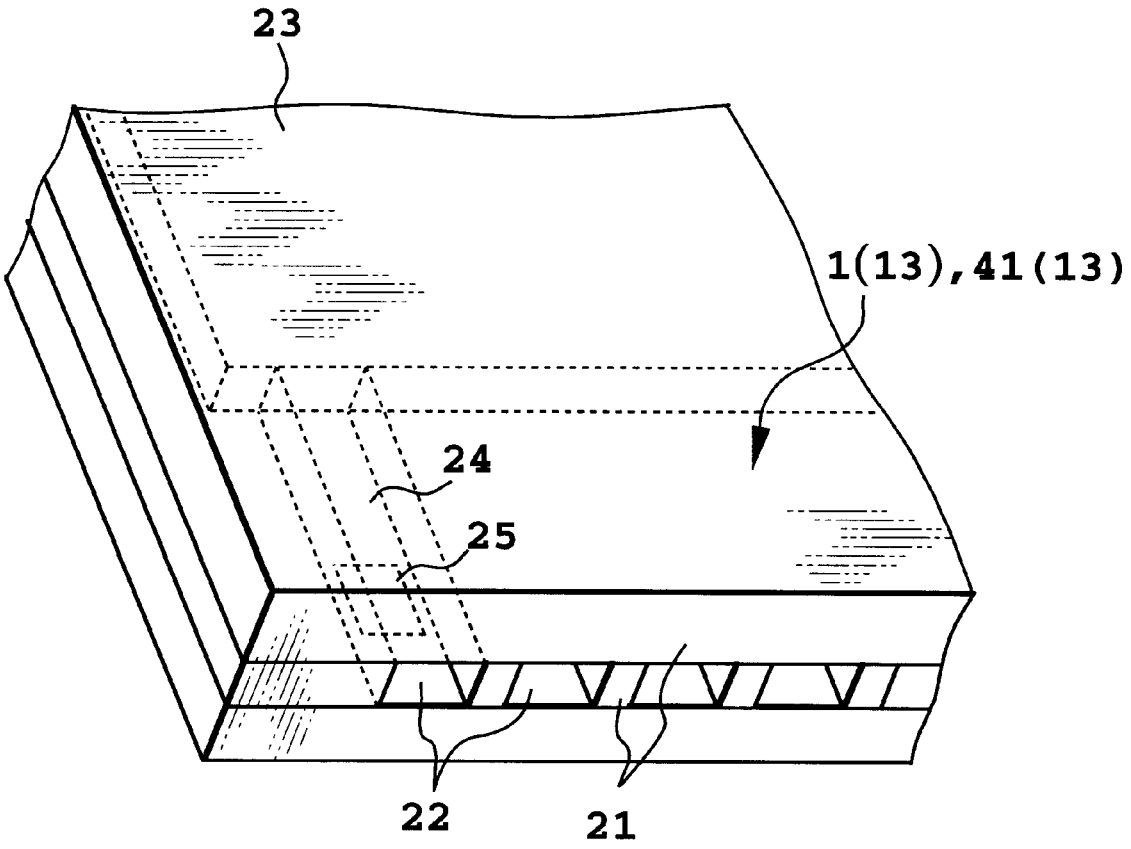
FIG. 3 is a perspective view diagrammatically showing a construction of a major portion of a printing head shown in FIG. 1 or FIG. 2.

FIG. 3 is a diagrammatic perspective view partially showing the construction of the major part of the head cartridge portion 13 of the head cartridge 1.

In FIG. 3, in the ejection opening surface 21 which opposes with the printing medium with maintaining a predetermined gap (e.g. about 0.5 to 2.0 mm), a plurality of ejection openings 22 are formed in a predetermined pitch. Each ejection opening 22 is connected to a common liquid chamber 23 through a liquid passage 24. The electrothermal transducer (heating resistor or the like)25 for generating the energy to be used for ejection of the ink, is arranged along a wall surface of the liquid passage 24. In the shown embodiment, the head cartridge is mounted on the carriage 2 in a positional relationship, in which the ejection openings 22 are aligned in a direction intersecting with the scanning direction of the carriage 2. Thus, the corresponding electrothermal transducer 25 (hereinafter "ejection heater") is driven (supplied an electric power) on the basis of an image signal or an ejection signal to cause film boiling in the ink within the liquid passage for ejecting the ink through the ejection opening 22 by the pressure generated by film boiling.

Figure 4:
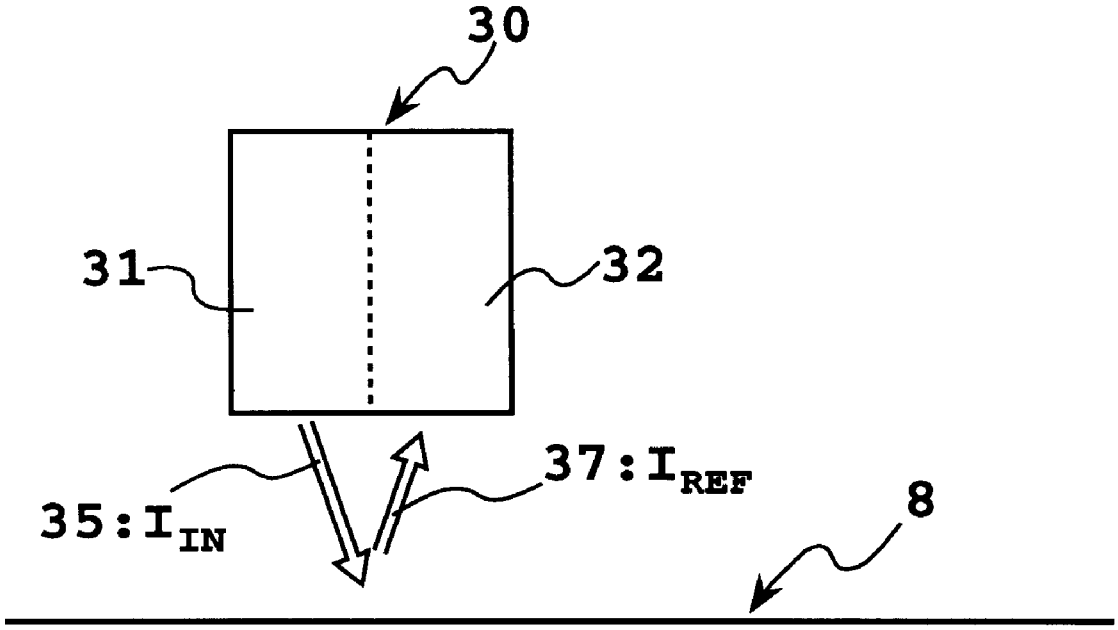
FIG. 4 is a diagrammatic illustration for explaining an optical sensor shown in FIG. 1 or FIG. 2.

FIG. 4 is a diagrammatic illustration for explaining a reflection type optical sensor 30 shown in FIG. 1 or FIG. 2.

As shown in FIG. 4, the reflection type optical sensor 30 is mounted on the carriage 2, as set forth above. The optical sensor 30 includes a light emitting portion 31 and a photosensing portion 32. A light Iin 35 emitted from the light emitting portion 31 is reflected by the printing medium 8, and the reflected light Iref 37 can be detected by the photosensing portion 32. Then, a detection signal is transmitted to a control circuit formed on a circuit board of the printing apparatus via a flexible cable(not shown). The detection signal is then converted into a digital signal by an A/D converter. A position where the optical sensor 30 is mounted on the carriage 2 is a position where the ejection opening portion of the print head 1 or 41 upon printing scan does not pass in order to prevent deposition of splashed droplet of the ink or the like. It should be noted since a sensor having relatively low resolution can be used as the optical sensor, a cost therefor becomes low.

Figure 5:
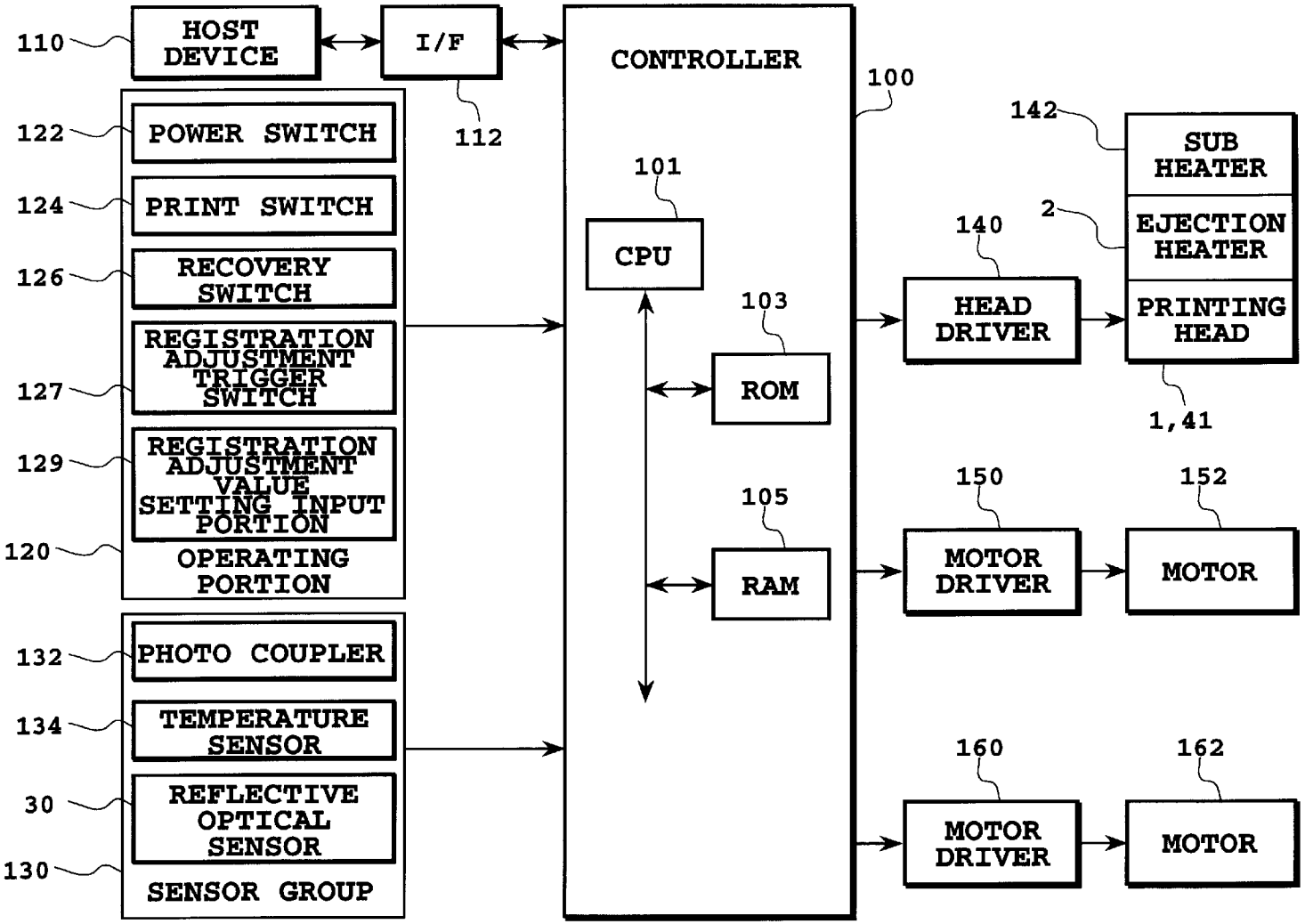
FIG. 5 is a block diagram showing a general construction of control circuit on one embodiment of an ink-jet printing apparatus according to the present invention.

FIG. 5 is a block diagram showing a general construction of control circuit on the above ink-jet printing apparatus.

In FIG. 5, controller 100 is a main controlling unit and comprises a CPU 101 of, for example, the form of microcomputer, a ROM 103 in which programs, tables and other fixed data are stored and a RAM 105 in which image data expanding area or working area are made. Host device 110 is a source of image data (it may be a computer making and processing image data for printing, otherwise it may be the form of reader or the like for image data reading). Image data, other commands and status signals or the like send to and receive from controller 100 via interface (I/F) 112.

Operating portion 120 is a switch group accepting command inputs from operator and comprises power switch 122, switch 124 instructing the start of printing, recovery switch 126 instructing the invocation of suck, registration adjustment trigger switch 127 for manual registration adjustment, registration adjustment value setting input 129 for manual inputting of the registration value and the like.

Sensor group 130 are sensors for detecting the status of the device and comprise the above reflective optical sensor 30, photo coupler 132 for detecting home position, temperature sensor 134 setting in the appropriate position for detecting temperature of circumstance and the like.

Head driver 140 is a driver which drives ejecting heater 25 of print head 1 or 41 according to printing data or the like. Head driver 140 comprises shift register aligning the print data according to the position of ejecting heater 25, latch circuit for latching at appropriate timing, components of logic circuit which synchronize with driving timing signal to activate the ejecting heater, timing setting portion setting appropriately driving timing (ejection timing) for dots forming position registration and the like.

In print head 1 or 41, sub heater 142 is setting. Sub heater 142 performs temperature adjustment for stabling ejection characteristics of ink. It may be the form of forming on the print head substrate with ejection heater 25 simultaneously and/or the form of setting on print head body or head cartridge.

Motor driver 150 is a driver for driving main scanning motor 152. Sub scanning motor 162 is a motor for moving (sub scanning) print medium 8 and motor driver 160 is a driver for the motor.

(Print Pattern for Print Registration)

In the following explanation, a ratio of a region printed by the printing apparatus versus a predetermined region on the printing medium will be referred to as "area factor". For example, when the dots are formed in overall area within the predetermined region on the printing medium, the area factor becomes 100%. Conversely, when no dot is formed within the predetermined region, the area factor becomes 0%. Also, when the area where the dots are formed, is a half of the predetermined region, the area factor becomes 50%.

Figure 6A:
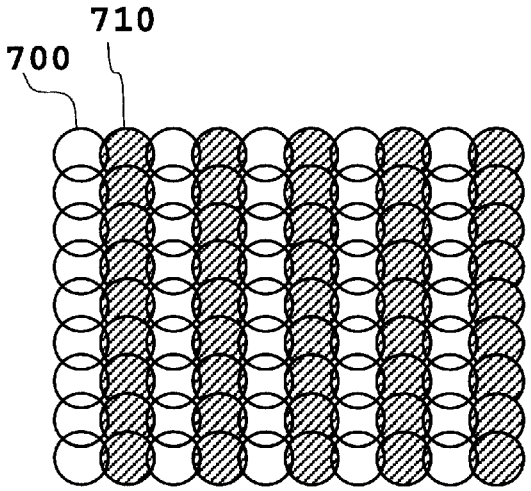
FIGS. 6A to 6C are diagrammatic illustrations respectively showing printing patterns to be used in the first embodiment of the present invention.
Figure 6B:
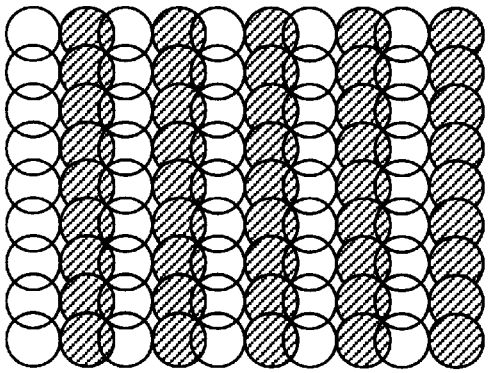
Figure 6C:
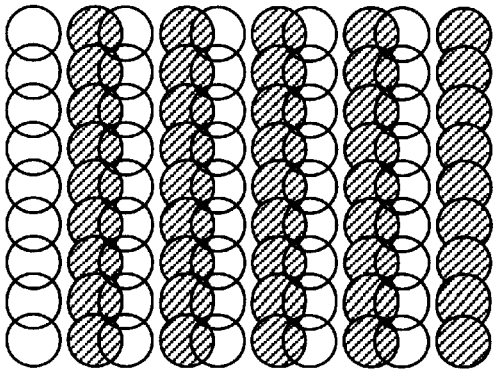

FIGS. 6A to 6C are diagrammatic illustrations showing printing patterns for printing registration to be used in the embodiment.

In FIGS. 6A to 6C, white dots 700 represent dots formed on the printing medium during the forward scan (first printing) and hatched dots 710 represent dots formed on the printing medium during the reverse scan (second printing). It should be appreciated that while colors of the dots are differentiated in FIGS. 6A to 6*c* for the purpose of illustration, these dots are the dots formed by the same ink from the same head cartridge. FIG. 6A shows a case where printing is performed in a condition printing positions in the forward scan and the reverse scan are well registered. FIG. 6B shows a case where the printing positions are registered with a slight offset. FIG. 6C shows a case where the printing positions are registered with a greater offset. It should be noted that, as can be appreciated from these figures, in the shown embodiment, complementary dots are formed in the bidirectional scan. Namely, the dots in the odd number columns are formed in the forward scan, and the dots in the even number columns are formed in the reverse scan. Accordingly, the case where respective dots formed in the forward scan and the reverse scan are distanced for about one dot as shown in FIG. 6A, is the well registered condition.

The printing pattern is designed to lower a density of the overall printing portion according to increasing of offset of the printing position. Namely, within a range of patch as the printing pattern of FIG. 6A, the area factor is about 100%. According to increase of offset of the printing positions as shown in FIGS. 6B and 6C, overlapping amount of the dot (white dot) of the forward scan and the dot (hatched dot) of the reverse scan becomes greater to widen the region not printed to lower area factor to reduce average density.

In the embodiment, by offsetting the timing of printing, printing positions are offset. It is possible to offset on printing data.

In FIGS. 6A to 6C, the printing pattern are illustrated with taking one dot in the scanning direction as unit, number of dots to form a column to be printed may be set depending upon precision of printing registration or precision of printing registration detection or the like, in practice.

Figure 7A:
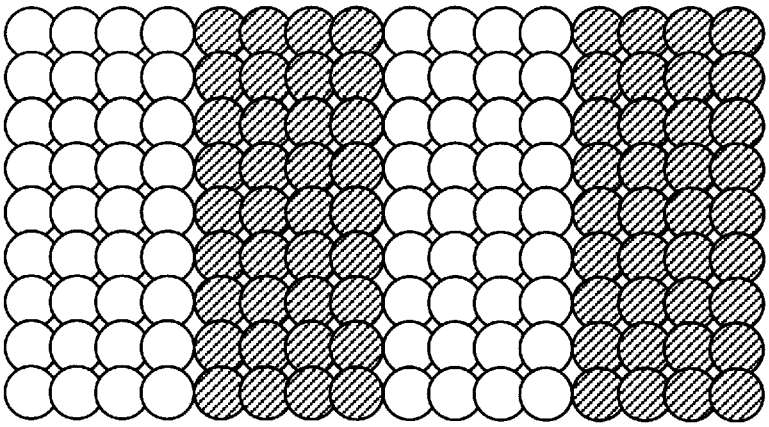
FIGS. 7A to 7C are diagrammatic illustrations respectively showing patterns for printing registration to be used in the first embodiment of the present invention.
Figure 7B:
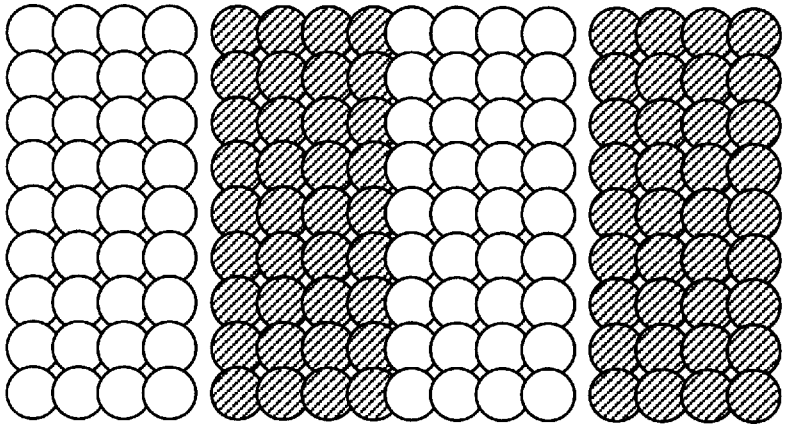
Figure 7C:
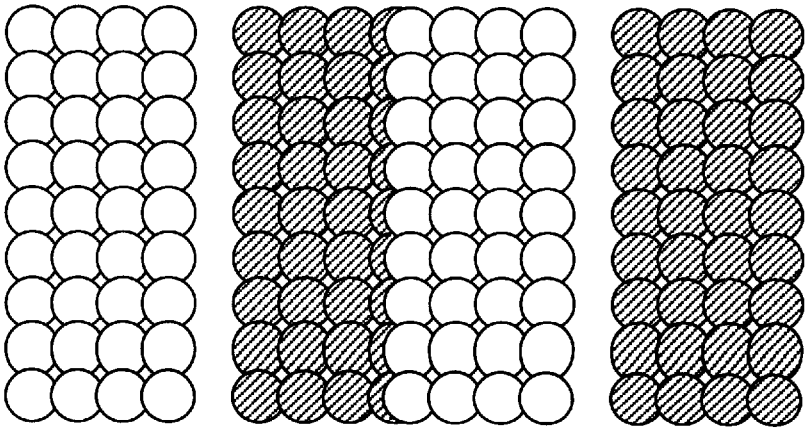

FIGS. 7A to 7C show the case where four dots are taken as unit. FIG. 7A shows a case where printing is performed in a condition printing positions in the forward scan and the reverse scan are well registered. FIG. 7B shows a case where the printing positions are registered with a slight offset. FIG. 7C shows a case where the printing positions are registered with a greater offset.

What is intended by this pattern is that the area factor is reduced with respect to increasing of mutual offset of the printing positions in the forward scan and the reverse scan. This is because the density of the printing portion is significantly depend on variation of the area factor. Namely, while density becomes higher at the overlapping portion of the dots, increasing of the not printed region has greater influence for the average density of the overall printing portion.

Figure 8:
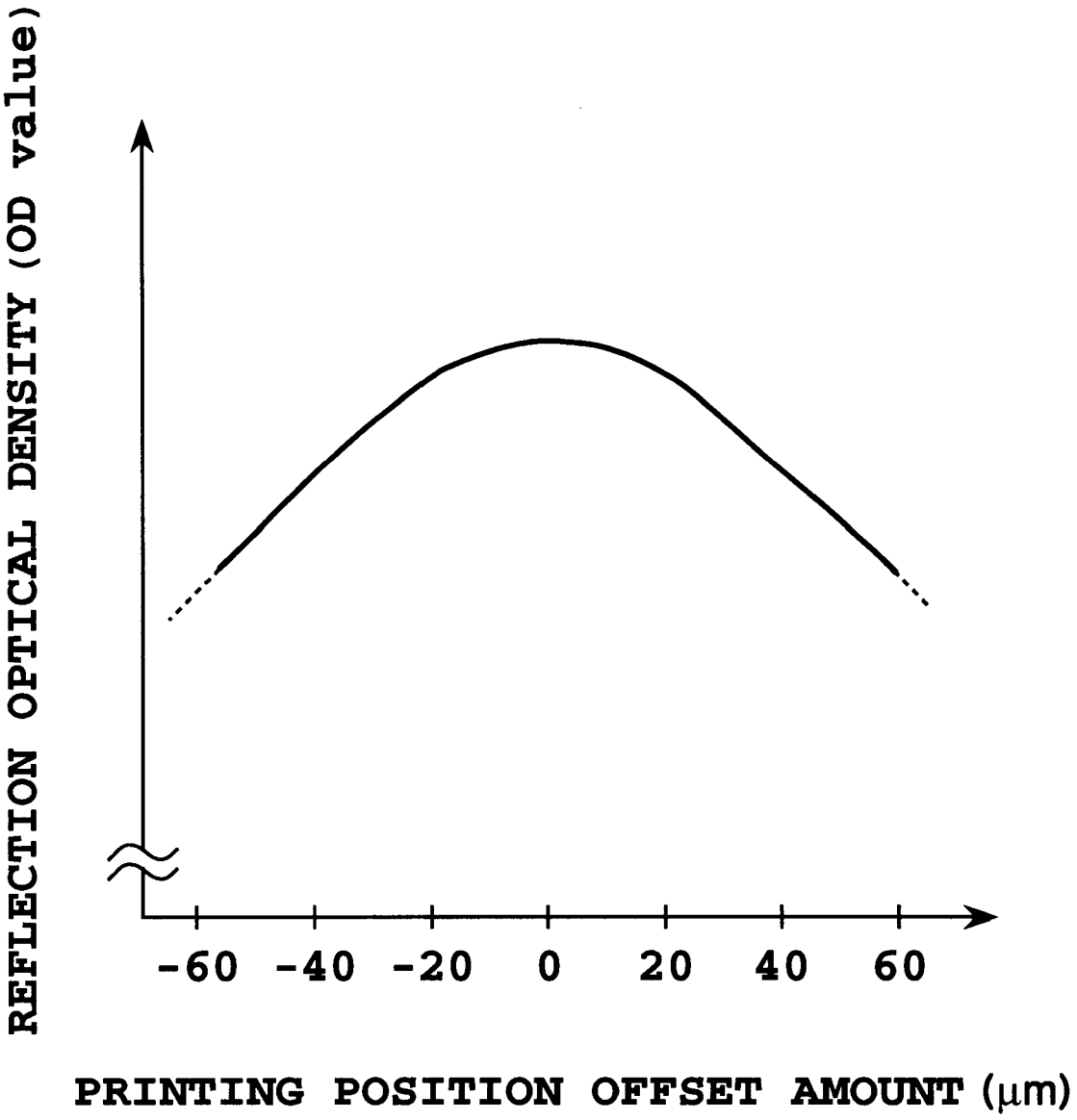
FIG. 8 shows a relationship between printing position offset amount and reflection optical density on printing patterns of the first embodiment of the present invention.

FIG. 8 is an illustration showing a relationship of variation of the offset amount of the printing position and a reflection optical density in the printing patterns shown in FIGS. 6A to 6C, FIGS. 7A to 7C of the shown embodiment. Relative offset of the printing positions in any direction results in reduction of the reflection optical density.

In FIG. 8, an ordinate is a reflection optical density (OD value) and an abscissa is a printing position offset amount ($\mu$m). Using incident light Iin 35 and reflection light Iref 37, reflection index R=Iref/Iin and transmission index T=1−R.

Let d is a reflection optical density, then $R=10^{-d}$. When the amount of printing position offset is zero, area factor becomes 100% and reflection index R becomes minimum. Namely, reflection optical density d becomes maximum. Reflection optical density d decreases when printing position offsets relatively to either of the direction of +−.

(Printing Registration Process)

Figure 9:
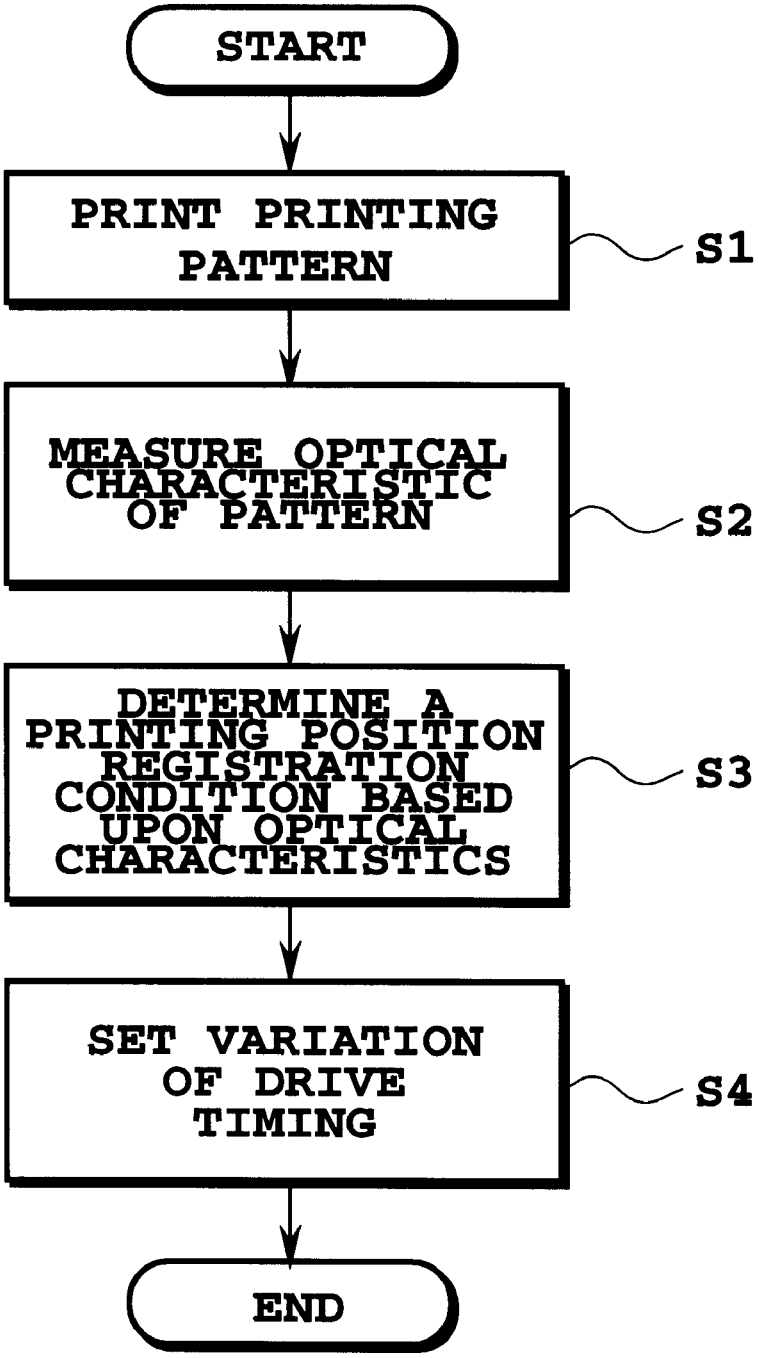
FIG. 9 is a flowchart showing a general processing of the first embodiment of the present invention.

FIG. 9 shows a general flowchart of printing registration process.

Figure 11:
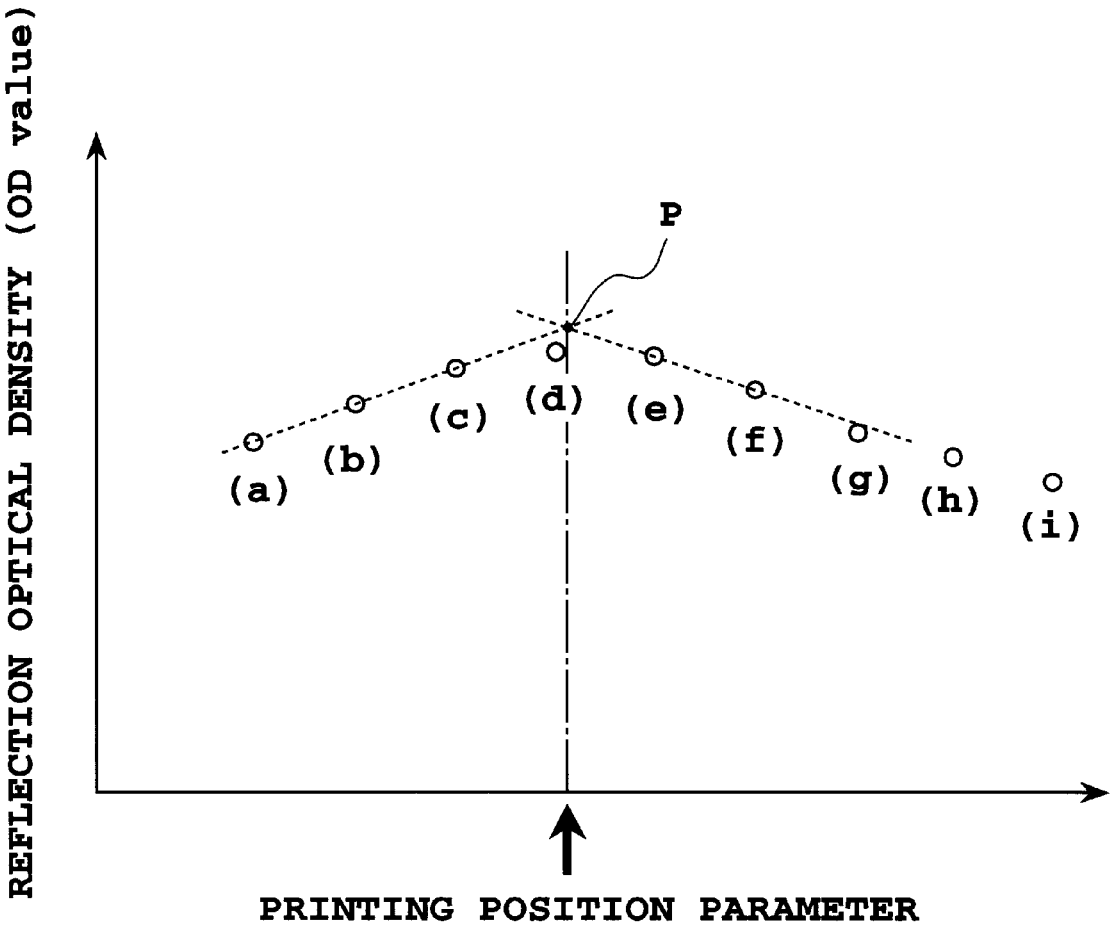
FIG. 11 is an illustration for explaining a method of determining a printing registration condition in the first embodiment of the present invention.
Figure 12:
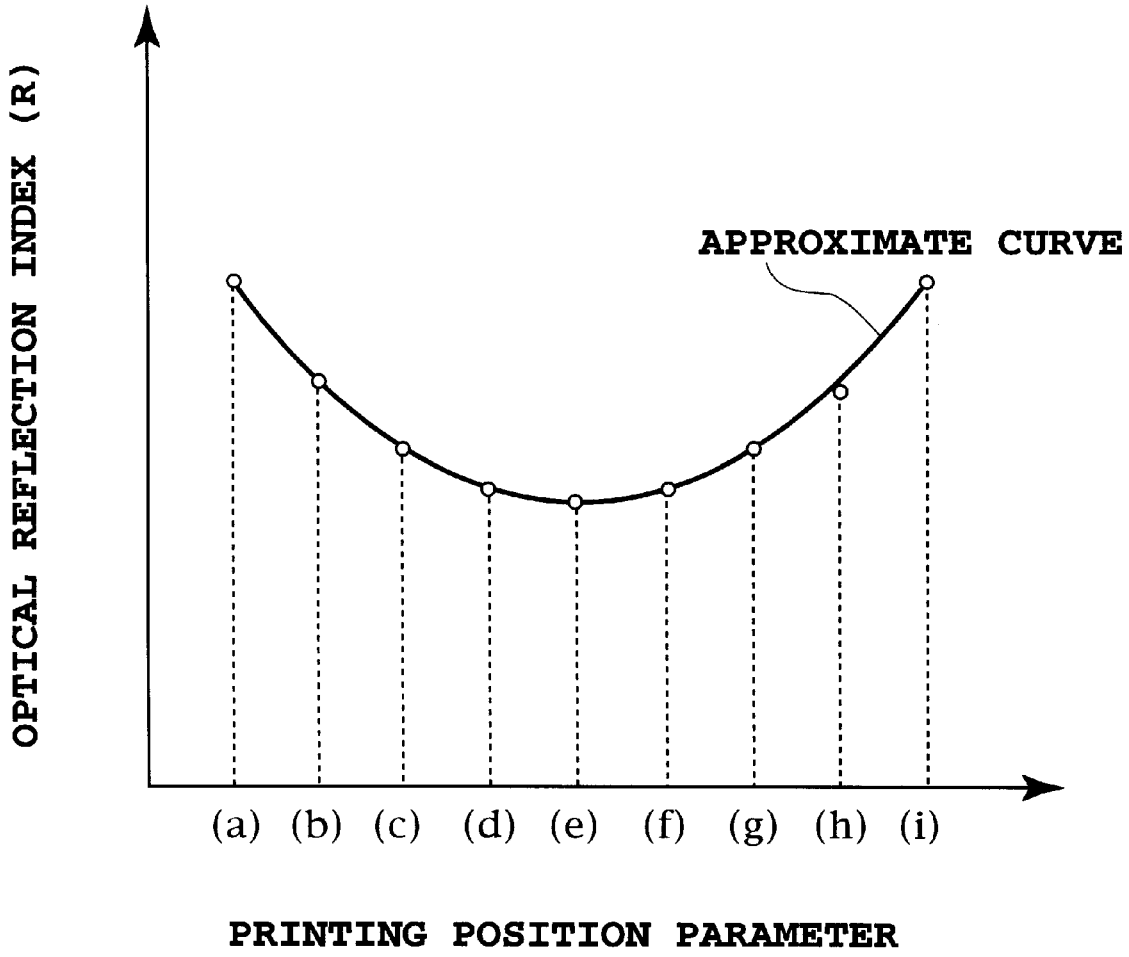
FIG. 12 shows a relationship between measured optical reflection index and printing position parameters.

In FIG. 9, first of all, printing patterns are printed (step S1). Next, the optical characteristics of the printing patterns are measured by optical sensor 30 (step S2). Based on optical characteristics obtained from the measured data, appropriate printing registration condition is found (step S3). As shown in FIG. 11 (below), the point of the highest reflection optical density is found, two straight lines respectively extending through both sides of data of the point of the highest reflection optical density are found by the method of least squares, the intersection point P of these lines is found. Like the above approximation using straight lines, approximation using curved line as shown in FIG. 12 (below) may be used. By the printing position parameter corresponding to the point P, variation of drive timing is set (step S4).

Figure 10:
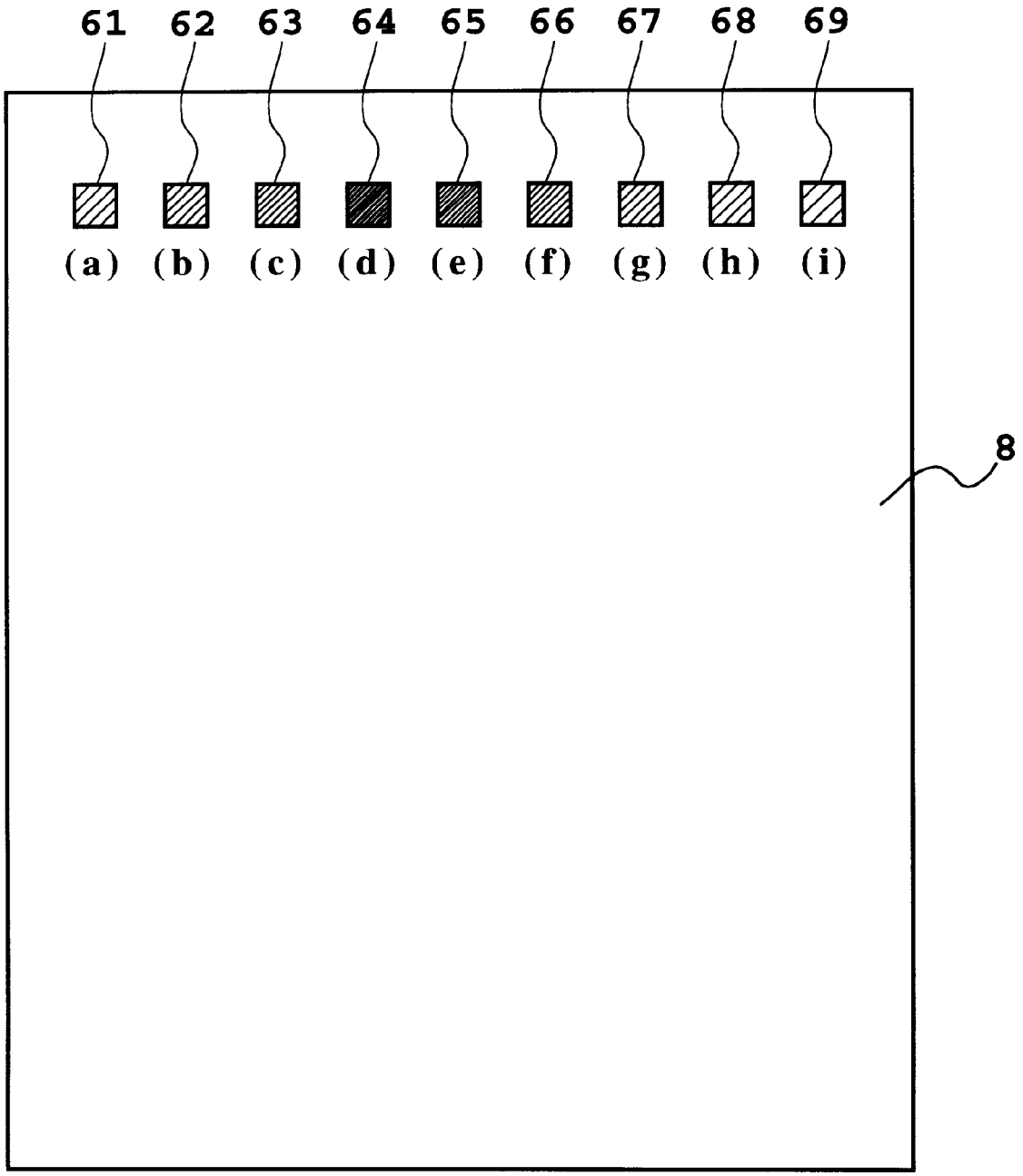
FIG. 10 is a diagrammatic illustration showing a condition where the printing pattern is printed on a printing medium.

FIG. 10 is an illustration showing a condition where the printing pattern shown in FIGS. 7A to 7C are printed on the printing medium 8. In the shown embodiment, nine patterns 61 to 69 respectively having different position offset amount between the dots printed in the forward scan and the reverse scan are printed. Each printed patterns is called patch, for example, patch 61, patch 62 or the like printing position parameters corresponding to the patch 61 to 69 are represented as (a) to (i). Nine patterns may be established by fixing the printing start timing in the forward scan and setting the printing start timing in the reverse scan at a currently set timing, four mutually different earlier timing than the currently set timing and four mutually different later timing than the currently set timing. It should be appreciated that setting of the printing start timings and printing of the nine patterns on the basis of set printing start timings may be executed by a program triggered by a predetermined command input.

Then, the printing medium and the carriage 2 are moved so that the optical sensor 30 mounted on the carriage may be placed in opposition with the patch as the printed patterns thus printed. In a condition where the carriage is stably stopped, the reflection optical density is measured. By performing measurement under the condition where the carriage 2 is stably stopped, influence of noise due to driving of the carriage can be avoided. Also, by making a measurement spot of the optical sensor 30 wider relative to the dot by providing greater distance between the sensor 30 and the printing medium 8, for example, local optical characteristics (fro example, reflection optical density) fluctuation on the printed pattern can be successfully averaged to achieve high precision in measurement of the density of the patch 60 or the like.

With taking a construction where the measurement spot of the optical sensor 30 is relatively wide, it is desired that a sensor having lower resolution than a printing resolution of the pattern, namely a sensor having greater measurement spot diameter than a dot diameter is used. Furthermore, in viewpoint of obtaining an average density, it is also possible to scan the patch by means of a sensor having relatively high resolution and to take an average of thus measured density as the measured density.

It should be appreciated that, in order to avoid influence of fluctuation in measurement, it may be possible to measure the reflection optical density of the same patch for a plurality of times and to take an average value of the measured densities as the measured density.

In order to avoid influence of fluctuation in measurement, it may be possible to measure a plurality of points on patch to average or perform other operations on them. It is possible to move carriage 2 and measure for saving time. In this case, in order to avoid fluctuation in measurement by electric noise generated on motor driven, it is strongly desired to increase the times of samplings and average or perform other operations on them.

FIG. 11 is an illustration diagrammatically showing an example of data of the measured reflection optical density.

In FIG. 11, the horizontal axis represents a parameter for varying the relative printing positions in the forward scan and the reverse scan. As the parameter, the printing start timing of the reverse scan in relation to the fixed printing start timing of the forward scan, to be advanced and retarded relative to the latter, may be taken.

When a result of measurement shown in FIG. 11 is obtained, in the shown embodiment, an intersection point P of two straight lines respectively extending through two points (the points each corresponding to printing position parameters (b), (c) and (e), (f) of FIG. 11) on both sides of the point where the reflection optical density is the highest (the point corresponding to printing position parameter (d) in FIG. 11), is taken as the printing position where the best printing registration is attained. Then, the printing position parameter corresponding to this point P, namely the printing start timing of the reverse scan corresponding to this point, is set. But, when strict print registration is not desired or is not needed, printing position parameter (d) may be used.

As can be appreciated from FIG. 11, by this method, the printing registration condition can be selected at smaller pitch than a pitch of the printing registration condition used in the printing pattern 61 etc. or higher resolution.

In FIG. 11, between the points where density is high the density is not varied significantly relative to a difference of the printing condition. Between the points corresponding to printing position parameters (a), (b), (c) and between the points corresponding to printing position parameters (f), (g), (h), (i), the density is varied sensitively relative to variation of the printing registration condition. When a characteristics of the density close to symmetry as in the shown embodiment is shown, printing registration is to be established at higher precision by deriving the printing registration condition using printing with the data point, where the density is varied sensitively relative to variation of the printing registration condition.

A method of derivation of the printing registration condition is not specified to the foregoing method. It is only intended that an numerical computation is performed with continuous values on the basis of a plurality of multi-value density data, information of the printing registration condition using the pattern printing for deriving the printing registration condition at a precision higher than a discrete value of the printing registration condition of the pattern printing.

For example, as example other than linear approximation shown in FIG. 11, with respect to a plurality printing registration condition using print of the patterns, a polynomial approximate expression is obtained on the basis of these density data employing a least square method and the condition for attaining the best printing registration may be derived by using the obtained expression. It is possible to use not only polynomial approximation, but also spline interpolation.

Even when the final printing condition is selected from a plurality of printing registration condition using the pattern printing, printing registration can be established with high precision with respect to fluctuation of various data by deriving the printing registration condition through numerical computation using a plurality of multi-value data. For example, if a method to select the point of the highest density from the data of FIG. 11, it is possible that the density at the point corresponding to printing position parameter (d) is higher than the density of the point corresponding to printing position parameter (e) due to fluctuation. Therefore, with taking the method obtaining an approximate line from each three points of both sides of the highest density point to derive intersection point, influence of fluctuation can be reduced by performing calculation using data of more than two points.

Next, another examples of deriving printing registration condition shown in FIG. 11 is explained.

FIG. 12 shows an example of measured optical reflection index.

In FIG. 12, the vertical axis represents optical refection index and the horizontal axis represents printing position parameters (a) to (i) for varying the relative printing positions in the forward scan and the reverse scan. For example, they correspond to be faster or slower printing timing of reverse scan to vary printing position. In the example, representative point on patch is determined from measured data ,and from the representative point, overall approximate curve is obtained and minimum point of the curve is determined as matched point of printing position.

Concerning a plurality of printing registration condition as shown in FIG. 10, respectively square or rectangular patterns (patch) are printed in the shown embodiment, the present invention is not limited to the shown construction. Concerning respective printing registration condition, it is only required an area for performing density measurement. For example, it is possible to use a pattern, in which all of a plurality of printing patterns in FIG. 10 (patch 61 etc.) are connected. With taking such pattern, an area of the printing pattern can be made smaller.

However, such pattern is printed on the printing medium 8 by the ink-jet printing apparatus, upon using a certain kind of printing medium 8, when the ink is ejected to an area greater than a predetermined area, the printing medium 8 is expanded to possibly cause lowering of the precision of deposition of the ink droplet ejected from the head cartridge. For the printing pattern using the shown embodiment, such phenomenon can be avoided as much as possible.

It should be noted that, in the shown embodiment of the printing patterns shown in FIGS. 6A to 6C, a condition where the reflection optical density varies relative to offset of the printing position most sensitively is the condition where the printing positions in the forward scan and the reverse scan are consistent (the condition shown in FIG. 6A), where the area factor becomes substantially 100%. Namely, it is desirable that the region where the pattern is printed, is covered substantially completely.

However, as the pattern where the reflection optical density becomes smaller at greater offset of the printing positions, the foregoing condition is not essential. But, it is desired that a distance between the dots respectively printed in the forward scan and the reverse scan where the printing positions in the forward scan and the reverse scan are consistent, may be a range from a distance where dots are contacted to a distance where the dots overlap over the dot radius. Therefore, according to the offset from the best condition of printing registration, reflecting optical density varies sensitively. It should be noted that the distance relationship between the dots is realized in the case of the dot pitch and the size of the dots to be formed as set out below or when the distance relationship is artificially established upon pattern printing when the dots to be formed are relatively fine.

The printing patterns in the forward scan and the reverse scan are not necessarily aligned in the vertical direction.

Figure 13A:
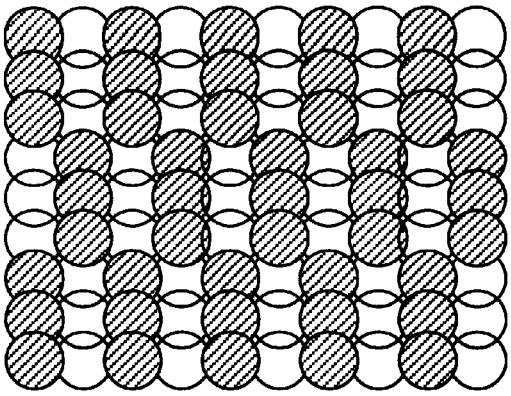
FIGS. 13A to 13C are diagrammatic illustrations respectively showing another examples of the printing patterns in the first embodiment of the present invention.
Figure 13B:
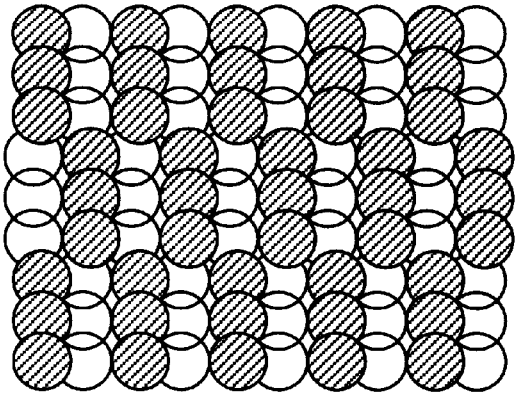
Figure 13C:
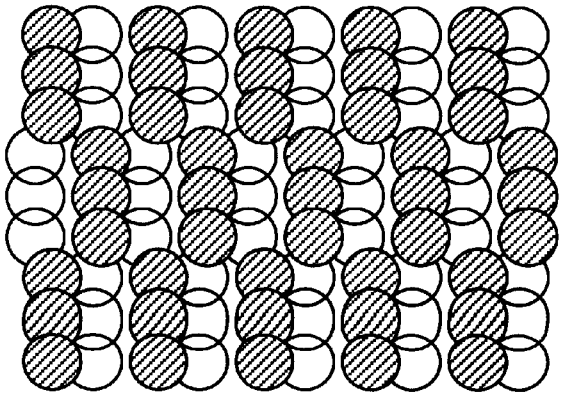

FIGS. 13A to 13C show patterns in which the dots to be printed in the forward scan and the dots to be printed in the reverse scan are mutually penetrate. It is possible to apply the present invention for those patterns. FIG. 13A shows a case where printing is performed in a condition printing positions in the forward scan and the reverse scan are well registered. FIG. 13B shows a case where the printing positions are registered with a slight offset. FIG. 13C shows a case where the printing positions are registered with a greater offset.

Figure 14A:
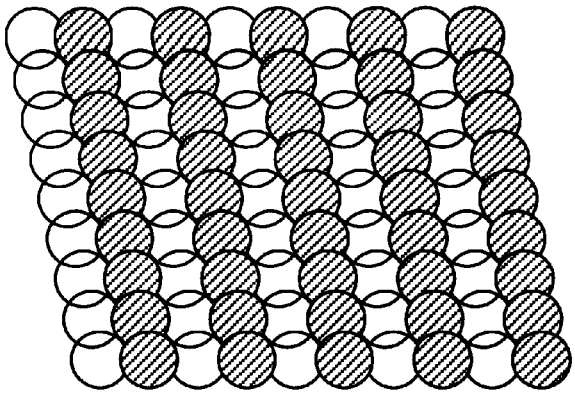
FIGS. 14A to 14C are diagrammatic illustrations respectively showing a further examples of the printing patterns in the first embodiment of the present invention.
Figure 14B:
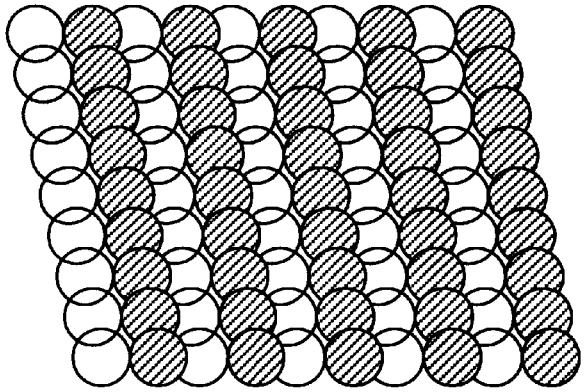
Figure 14C:
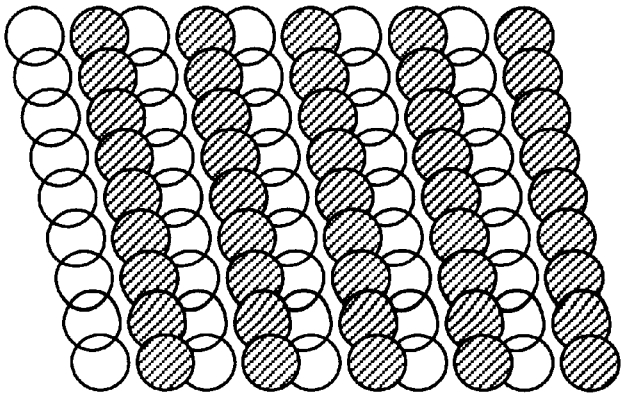

FIGS. 14A to 14C show patterns where the dots are aligned obliquely. It is possible to apply the present invention for those patterns. FIG. 14A shows a case where printing is performed in a condition printing positions in the forward scan and the reverse scan are well registered. FIG. 14B shows a case where the printing positions are registered with a slight offset. FIG. 14C shows a case where the printing positions are registered with a greater offset.

Figure 15A:
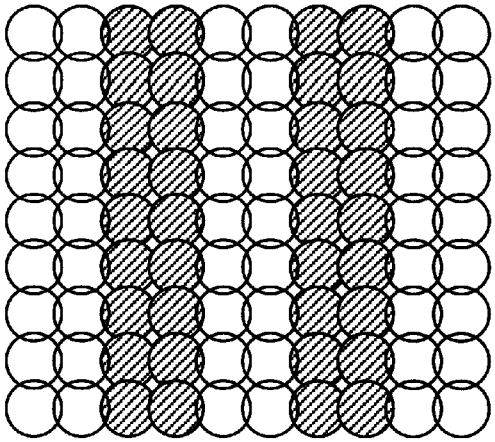
FIGS. 15A to 15C are diagrammatic illustrations respectively showing a still further examples of the printing patterns in the first embodiment of the present invention.
Figure 15B:
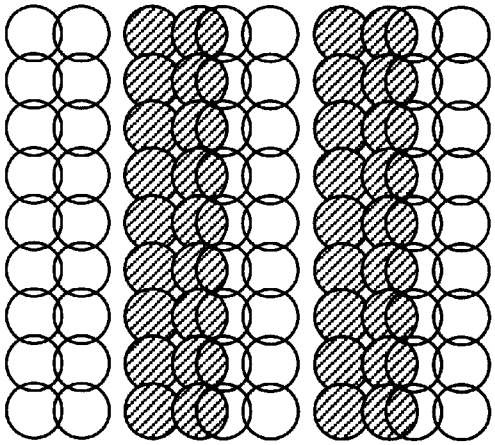
Figure 15C:
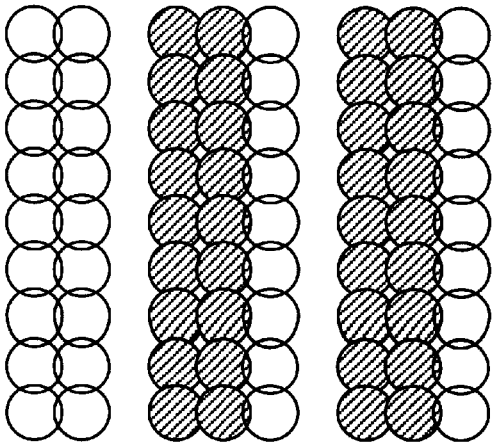

FIGS. 15A to 15C show patterns in which each columns of dots in forward and reverse scan with respect to printing position offsetting is a plurality of columns of dots.

When printing registration is performed by varying the printing registration condition in greater range, such as the printing start timing and the like, a pattern having a plurality of columns of dot arrays in respective of the forward scan and the reverse scan to be an object for providing offset of the printing positions as shown in FIGS. 15A to 15C, is effective. In the printing patterns shown in FIGS. 6A to 6C, since the set of the dot arrays to be object for providing offset is only one dot array for each of the forward scan and the reverse scan, the dot array may overlap with the dot array of another set according to increasing of offset amount of the printing position. The reflection optical density does not becomes further smaller even when the offset amount of the printing position becomes greater. In contrast to this, in case of the pattern shown in FIGS. 15A to 15C, a magnitude of the offset of the printing position to cause the dot array to overlap with the dot array in another set, can be set greater in comparison with the printing pattern of FIGS. 6A to 6C. By this, the printing registration condition can be varied in greater range.

Figure 16A:
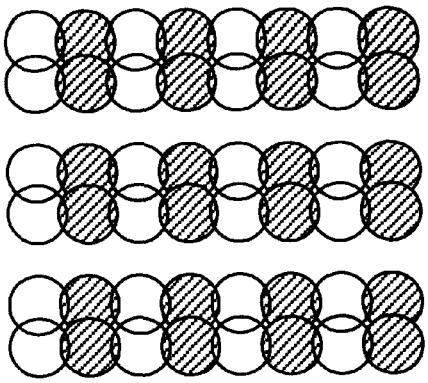
FIGS. 16A to 16C are diagrammatic illustrations respectively showing a yet further examples of the printing patterns in the first embodiment of the present invention.
Figure 16B:
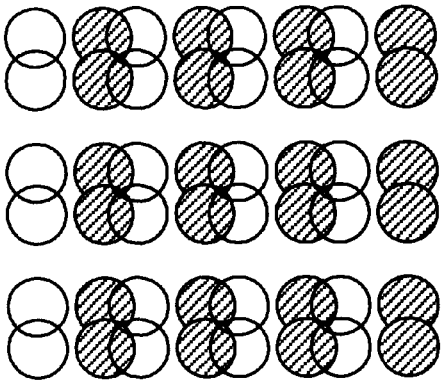
Figure 16C:
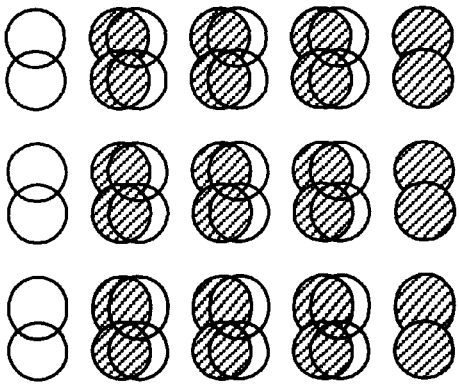

FIGS. 16A to 16C show printing patterns using predetermined thinned dots on each columns of dots.

It is also possible to apply the present invention to these patterns. In case of a pattern having greater density of the dot per se formed on the printing medium 8, this manner is effective when the density of the overall pattern when the pattern shown in FIGS. 6A to 6C is to be printed, becomes excessively high to make it impossible to measure a difference of output depending upon the offset of the dots by the optical sensor 30. Namely, by reducing the dots as shown in FIGS. 16A to 16C, the region on the printing medium 8 where is not printed is increased to lower density of the overall patch.

Conversely, when the printing density is too low, the dots are formed by performing printing on the same position, twice, or, in the alternative, by performing printing by twice printing only for a part.

The characteristics of the printing pattern to reduce the reflection optical density according to increasing offset amount of the printing position, requires a condition where the dot printed in the forward scan and the dot printed in the reverse scan are in contact in the carriage scanning direction. However, it is not necessary to satisfy such condition. In such case, the reflection density may be lowered according to increasing of offset amount of the printing positions in the forward scan and the reverse scan.

Second Embodiment

The second embodiment of the present invention concerns to the printing position in the carriage scanning direction between the different heads. On the other hand, when a plurality of kinds of printing mediums, inks, head cartridges and so on are employed, there is shown an example performing corresponding printing registration. Namely, the size and the density of the dots to be formed can be differentiated depending upon the kind of the printing medium or the like. Therefore, in advance of judgment of the printing registration condition, judgment is made that whether a measured value of the reflection optical density is a appropriate value necessary for judgment of the printing registration condition. As a result, if judgment is made that the measured reflection optical density value is not appropriate for judgment of the printing registration condition, the level of the reflection optical density is adjusted by thinning the printing pattern or overlappingly printing the dots.

In advance of judgment of the printing registration condition, judgment is made whether the measured reflection optical density is sufficiently lowered depending upon increasing of the offset amount of the printing position. As a result, if judgment is made that the reflection optical density is inappropriate for performing judgment of the printing registration condition, the dot interval in the varying direction of the offset, in this case, in the carriage scanning direction set in advance in the printing pattern is modified to again perform measurement of the printing of the printing pattern and measurement of the reflection optical density.

(Printing Registration Process)

In the shown embodiment, concerning the printing pattern explained in the foregoing first embodiment, among two head cartridges for which printing registration in the dots printed in the forward scan, the printing is performed by the first head cartridge and printing is performed by the second head cartridge to perform printing registration.

Figure 17:
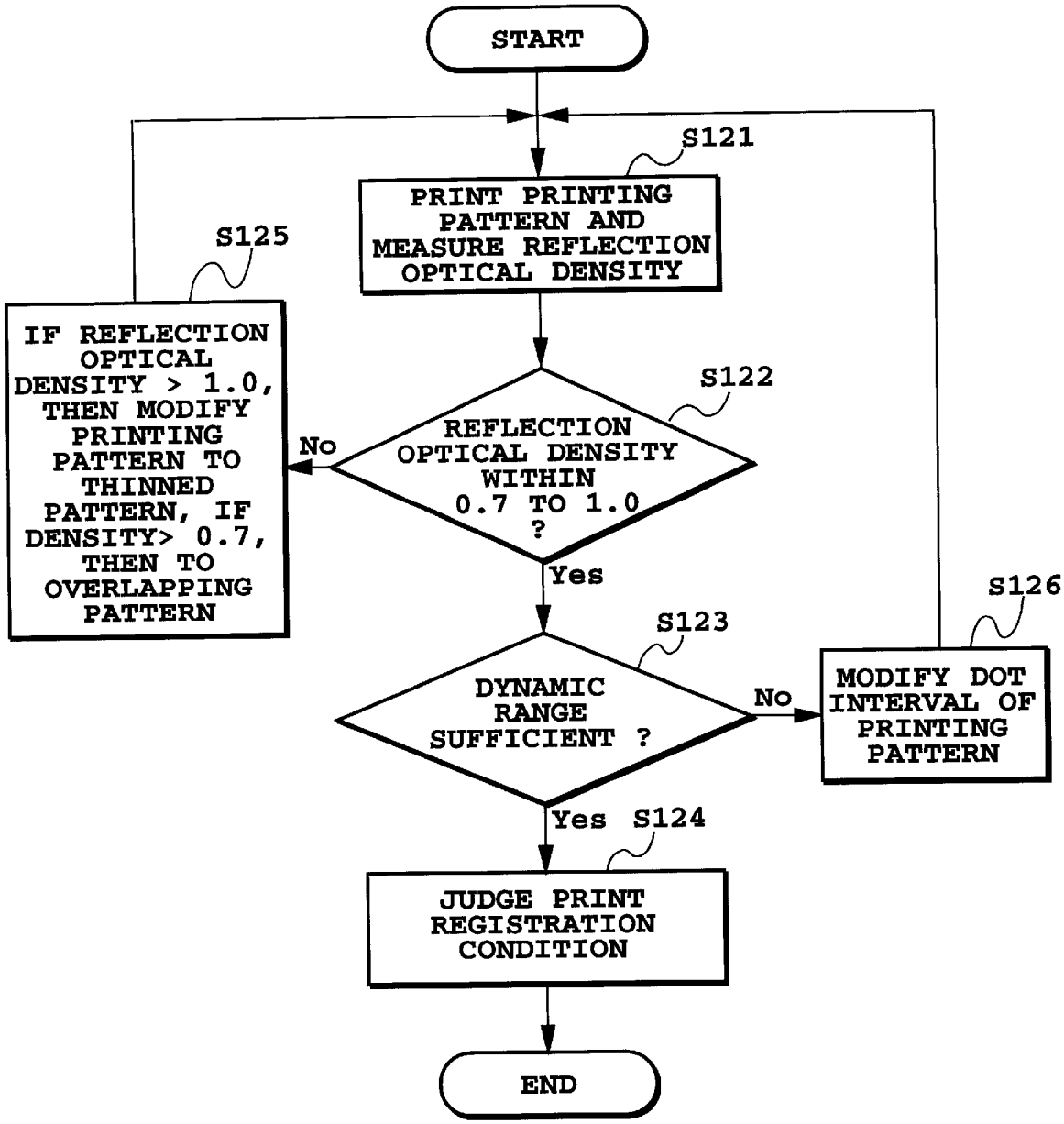
FIG. 17 is a flowchart showing a procedure of a printing registration condition judgment process in the second embodiment of the present invention.

FIG. 17 shows a flowchart showing a process procedure of the shown embodiment of printing registration.

As shown in FIG. 17, at step S121, nine patterns 61–69 shown in FIG. 10 are printed as the printing patterns. In conjunction therewith, the reflection optical density of the printing pattern is measured in the similar manner as the first embodiment.

Next, at step S122, among the measured values of the reflection optical densities, judgment is made whether one having the highest reflection optical density falls within a range of 0.7 to 1.0 of an OD value. If the value falls within the predetermined range, the process is advanced to a next step S123.

When judgment is made that the reflection optical density does not fall within the range of 0.7 to 1.0, the process is advanced to step S125. At step S125, the printing pattern is modified to patterns showing in FIGS. 16A to 16C thinned to be two third of the printing pattern when the value is greater than 1.0, and then process is returned to step S121. On the other hand, if the reflection optical density is smaller than 0.7, the printing pattern shown in FIGS. 16A to 16C is printed overlappingly over the printing pattern shown in FIGS. 6A to 6C.

It is also possible to prepare a large number of printing patterns for further modifying the printing pattern when inappropriateness is judged even in the second judgment. However, in the shown embodiment, under a premise that almost all cases may be covered with three kinds of patterns, the process is advanced to the next step even when inappropriateness is judged in the second judgment. Even if the printing medium 8, the head cartridge or the density of the pattern to be printed is varied by the judgment process of step S122, printing registration adapting to such change becomes possible.

Next, at step S123, check is performed whether the measured reflection optical density is sufficiently lowered in relation to the offset amount of the printing position, namely, whether a dynamic range of the value of the reflection optical density is sufficient or not. For example, in the case where the value of the reflection optical density shown in FIG. 11 is obtained, check is performed whether a difference between the value of the maximum density (corresponding point of printing position parameter (d) in FIG. 11) and two next values(the difference between corresponding points of printing position parameters (d) and (b), the difference between corresponding points of printing position parameters (d) and (f) in FIG. 11) is greater than or equal to 0.02 or not. If the difference is smaller than 0.2, judgment is made that the interval of the printing dots of the overall printing pattern is too short. Then, the distance between the printing dots is expanded at step S126, and the process from the step S121 and subsequent steps is performed.

The process at steps S123 and S124 will be explained in greater detail with reference to FIGS. 18A to 18*c*, FIGS. 19A to 19C and FIG. 20.

Figure 18A:
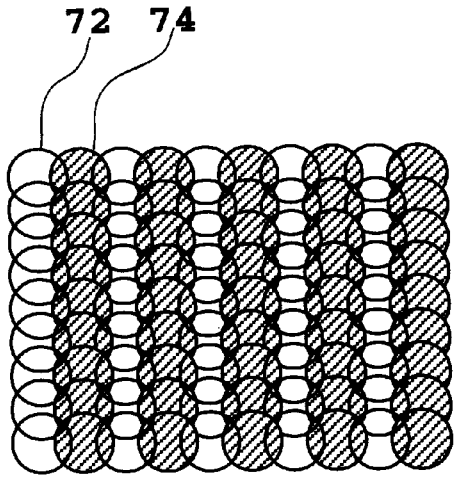
FIGS. 18A to 18C are diagrammatic illustrations for explaining characteristics depending upon a distance between dots of the printing pattern in the second embodiment of the present invention.
Figure 18B:
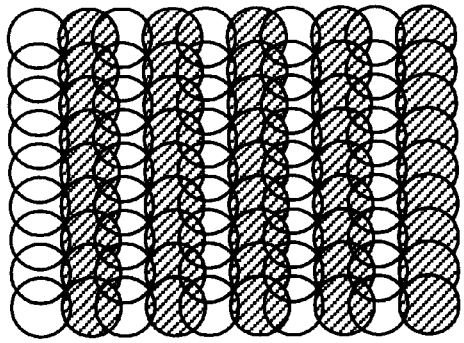
Figure 18C:
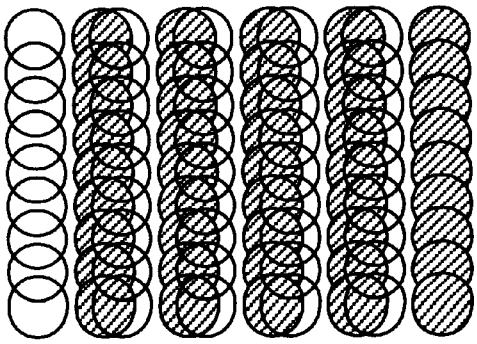

FIGS. 18A to 18C is a diagrammatic illustration showing a condition of the printing portion in the case where the printing dot diameter of the printing pattern shown in FIGS. 6A to 6C is large.

In FIGS. 18A to 18C, white dots 72 represent the dots printed by the first head cartridge, and the hatched dots 74 represent the dots printed by the second head cartridge. FIG. 18A shows the case where the printing positions of the white dots and the hatched dots are consistent. FIG. 18B shows the case where the printing positions of the white dots and the hatched dots are slightly offset. FIG. 18C shows the case where the printing positions of the white dots and the hatched dots are offset in greater amount than that of FIG. 18B. As can be appreciated from comparison of FIGS. 18A and 18B, when the dot diameter is large, the area factor is maintained at substantially 100% even if the printing positions of the white dots and the hatched dots are slightly offset, and thus the variation of the reflection optical density is little. Namely, the condition where the reflection optical density is sensitively decreased with respect to variation of the offset amount of the printing position, is not satisfied.

Figure 19A:
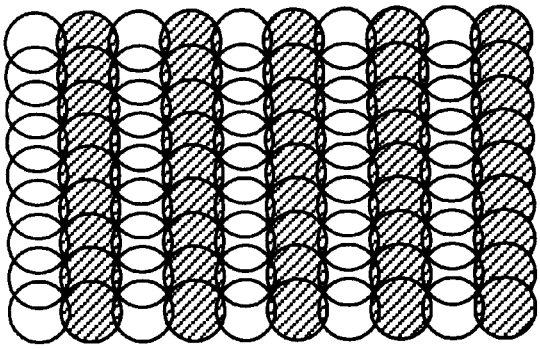
FIGS. 19A to 19C are diagrammatic illustrations for explaining characteristics depending upon a distance between dots of the printing pattern in the second embodiment of the present invention.
Figure 19B:
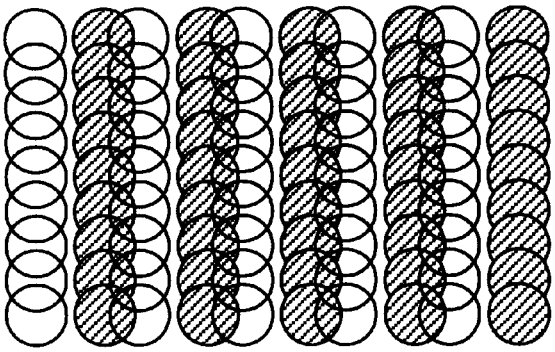
Figure 19C:
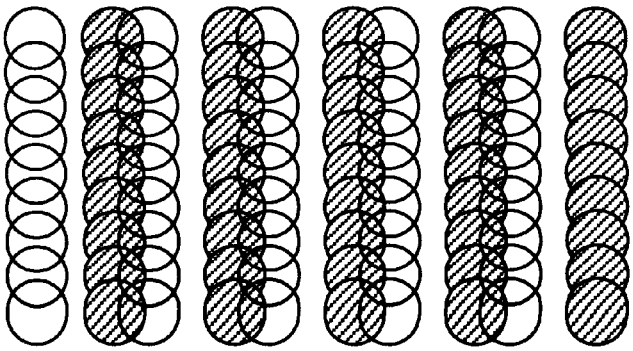

On the other hand, FIGS. 19A to 19C show the case where the interval between the dots in the carriage scanning direction in the overall pattern is expanded with maintaining the dot diameter. FIG. 19A shows the case where the printing positions of the white dots and the hatched dots are consistent. FIG. 19B shows the case where the printing positions of the white dots and the hatched dots are slightly offset. FIG. 19C shows the case where the printing positions of the white dots and the hatched dots are offset in greater amount than that of FIG. 19B. In this case, the area factor is reduced according to occurrence of the offset between the printed dots to lower reflection optical density.

Figure 20:
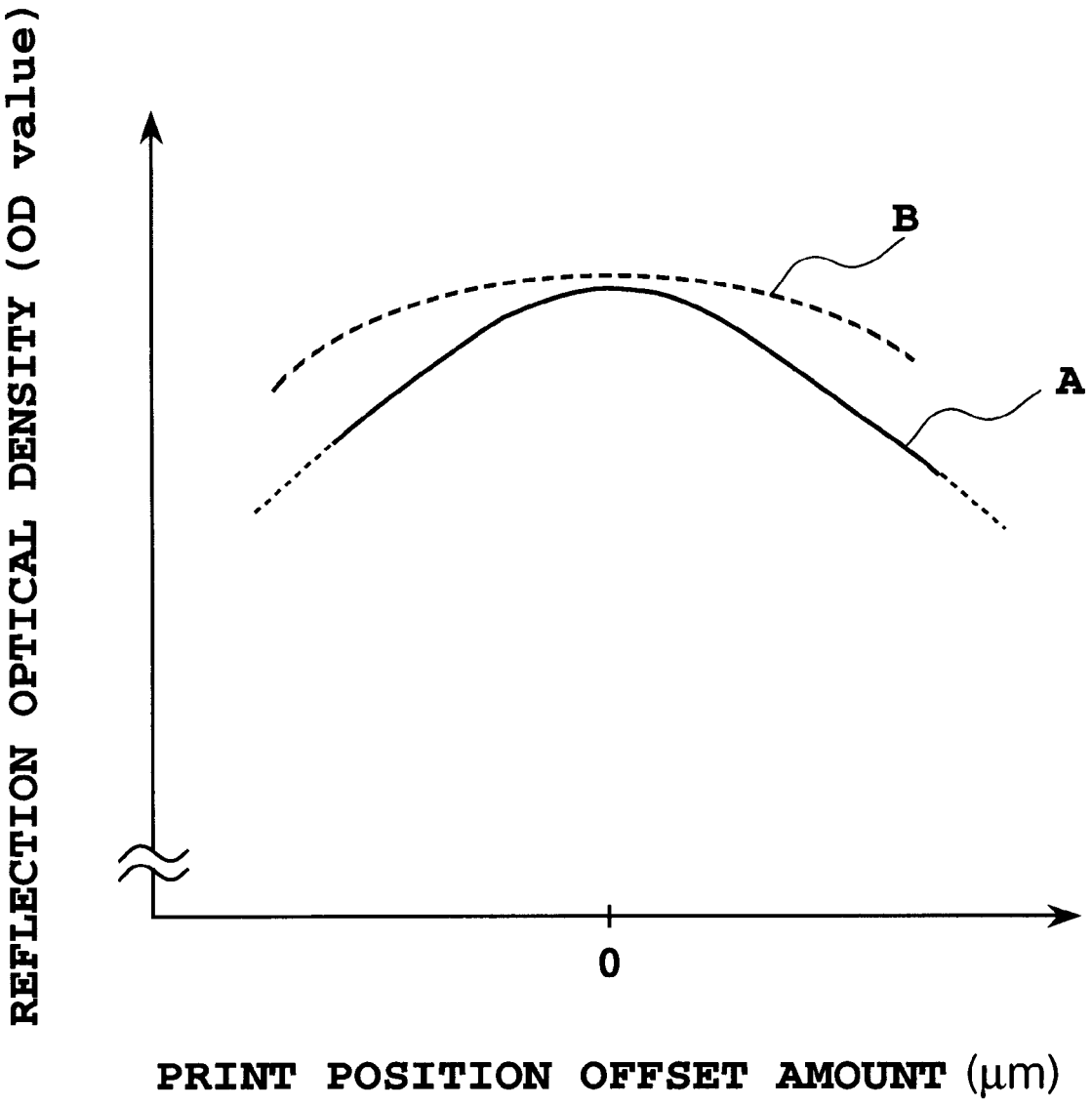
FIG. 20 is an illustration for explaining a characteristics of a reflecting optical density depending upon the distance between dots of the printing pattern in the second embodiment of the present invention.

FIG. 20 is a diagrammatic illustration showing a behavior of the density characteristics in the case where the printing patterns shown in FIGS. 18A to 18C and 19A to 19C are used.

In FIG. 20, the solid line shows variation of the value of the reflection optical density in the case where the printing is performed under a condition where the reflection optical density is sensitively lowered in response to variation of offset amount of the printing positions as set forth in connection with the first embodiment, and the broken line shows variation of the value of the reflection optical density where the reflection optical density when the dot interval is smaller than the former case. As can be clear from FIG. 20, when the dot interval is too small, the reflection optical density causes merely a little variation in response to slight offset from the ideal condition of the printing registration condition for the reason set forth above. Therefore, in the shown embodiment, the judgment shown in step S123 of FIG. 17 is performed to expand the distance between the dots depend on the judgment to establish the printing condition suitable for performing judgment of the printing registration condition.

In the shown embodiment, the dot interval is to be short, initially. Then, the dot interval is expanded until a proper dynamic range of the reflection optical density being attained. However, even if proper dynamic range of the reflection optical density is not obtained even after expansion of the dot interval for four times, the process is advanced to the next process for making judgment of the printing registration condition. It should be noted that, in the shown embodiment, the dot interval is adjusted by varying driving frequency of the head cartridge with maintaining the carriage 2 scanning speed. By this, the distance between the dots becomes longer at smaller driving frequency of the head cartridge. On the other hand, as another method for adjusting the distance between the dots, the carriage 2 scanning speed may be varied.

In the either case, the driving frequency or scanning speed for printing the printing pattern become different from the driving frequency or the scanning speed to be used in actual printing operation. Accordingly, after checking of the printing registration for printing, difference of the driving frequency or the scanning speed has to be corrected. This correction may be performed arithmetically. In the alternative, it is possible to preliminarily prepared data of printing timing relating to the actual driving frequency or the scanning speed for respective of nine patterns 61 as shown in FIG. 10, to use the preliminarily derived data according to the result of checking of the printing registration condition. In the alternative, in the case shown in FIG. 11, the printing timing to be used for printing can be derived by linear interpolation.

A method of judgment of the printing registration condition is similar to that of the first embodiment. On the other hand, in printing registration in the forward scan and the reverse scan in bidirectional printing in the first embodiment, varying of distance between dots of the printing pattern with respect to the size of the dot diameter performed in the shown embodiment is equally effective similarly to the shown embodiment. It should be noted that, in this case, the printing patterns for the forward scan and the reverse scan are prepared for respective printing patterns of several number of the distance between the dots to be used. Then, data of the printing timings are preliminarily derived per the printing pattern and the dot interval for deriving the printing timing to be used for printing by performing linear interpolation according to the result of the judgment of the printing position.

It should be noted that a flowchart shown in FIG. 17 is applicable for the following embodiments with appropriate modification and so on.

Third Embodiment

The third embodiment of the present invention concerns printing registration in a direction perpendicular to the carriage scanning direction, between a plurality of heads. It should be noted that explanation will be given for the printing apparatus using only one kind of the printing medium, the head cartridge and the ink.

(Method for Correcting Printing Position)

In the shown embodiment of the printing apparatus, in order to perform correction of the printing position in the direction perpendicular to the carriage scanning direction (auxiliary scanning direction), the ink ejecting openings of the head cartridge is provided over a range wider than a width (band width) in the auxiliary scanning direction of the image formed by one scan so as to permit correction of the printing position in a unit of an interval of the ejection openings by using with shifting the range of the ejection openings to be used. Namely, as a result of shifting of correspondence between the data (image data or the like) to be output and the ink ejection openings, it becomes possible to shift the output data per se.

(Printing Pattern)

In the foregoing first and second embodiments, the printing pattern, in which the measured reflection optical density becomes maximum when the printing position is consistent is used. However, in the shown embodiment, the reflection optical density becomes minimum when the printing positions are consistent. According to increasing of the offset amount of the printing positions, the reflection optical density in the shown pattern is increased.

Even in the case of printing registration in the paper feeding direction, similarly to the foregoing first and second embodiments, it is possible to employ a pattern, in which the density becomes maximum in the condition where the printing positions are consistent and is decreased according to increasing of offset amount in the printing positions. For example, it becomes possible to perform printing registration with paying attention for dots formed by each ejection in adjacent positional relationship in the paper feeding direction between two heads, for example.

Figure 21A:
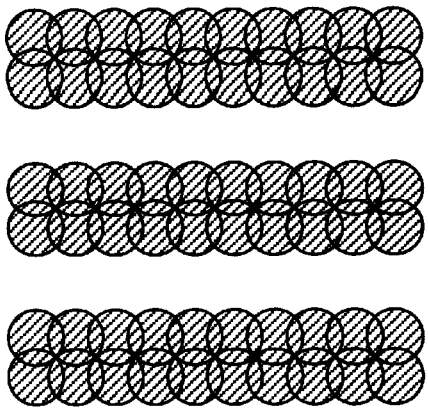
FIGS. 21A to 21C are diagrammatic illustrations showing printing patterns in the third embodiment of the present invention.
Figure 21B:
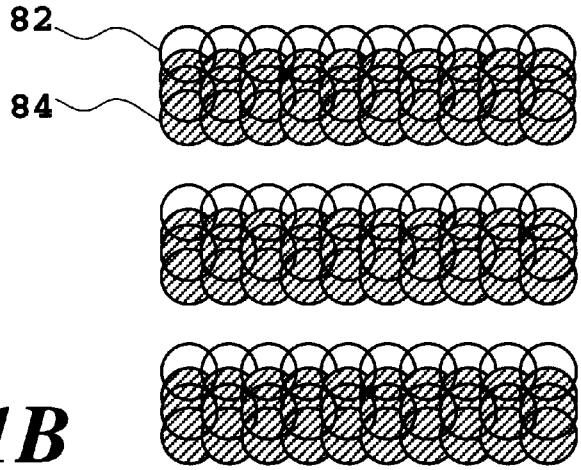
Figure 21C:
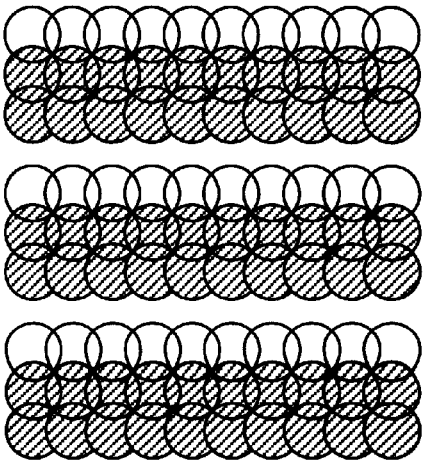

FIGS. 21A to 21C diagrammatically show the printing pattern to be used in the shown embodiment.

In FIGS. 21A to 21C, a white dot 82 is the dot printed by the first head cartridge, and a hatched dot 84 is the dot printed by the second head cartridge. FIG. 21A shows the case where the printing positions are consistent. However, since two kinds of dots are overlapped, the white dot is not visually perceptible. FIG. 21B shows the dot printed in the condition where the printing position is slightly offset, and FIG. 21C shows the dot condition where printing positions are further offset. As can be seen from FIGS. 21A to 21C, according to increasing of offset amount of the printing position, the area factor is increased to increase average reflection optical density as a whole.

(Printing Registration Process)

By providing an offset for the ejection openings of one of the head cartridge among two head cartridges to be used for adjustment of printing registration, five printing patterns are printed with varying printing registration condition with respect to offsetting. Then, the reflection optical density of the printed patch is measured.

Figure 22:
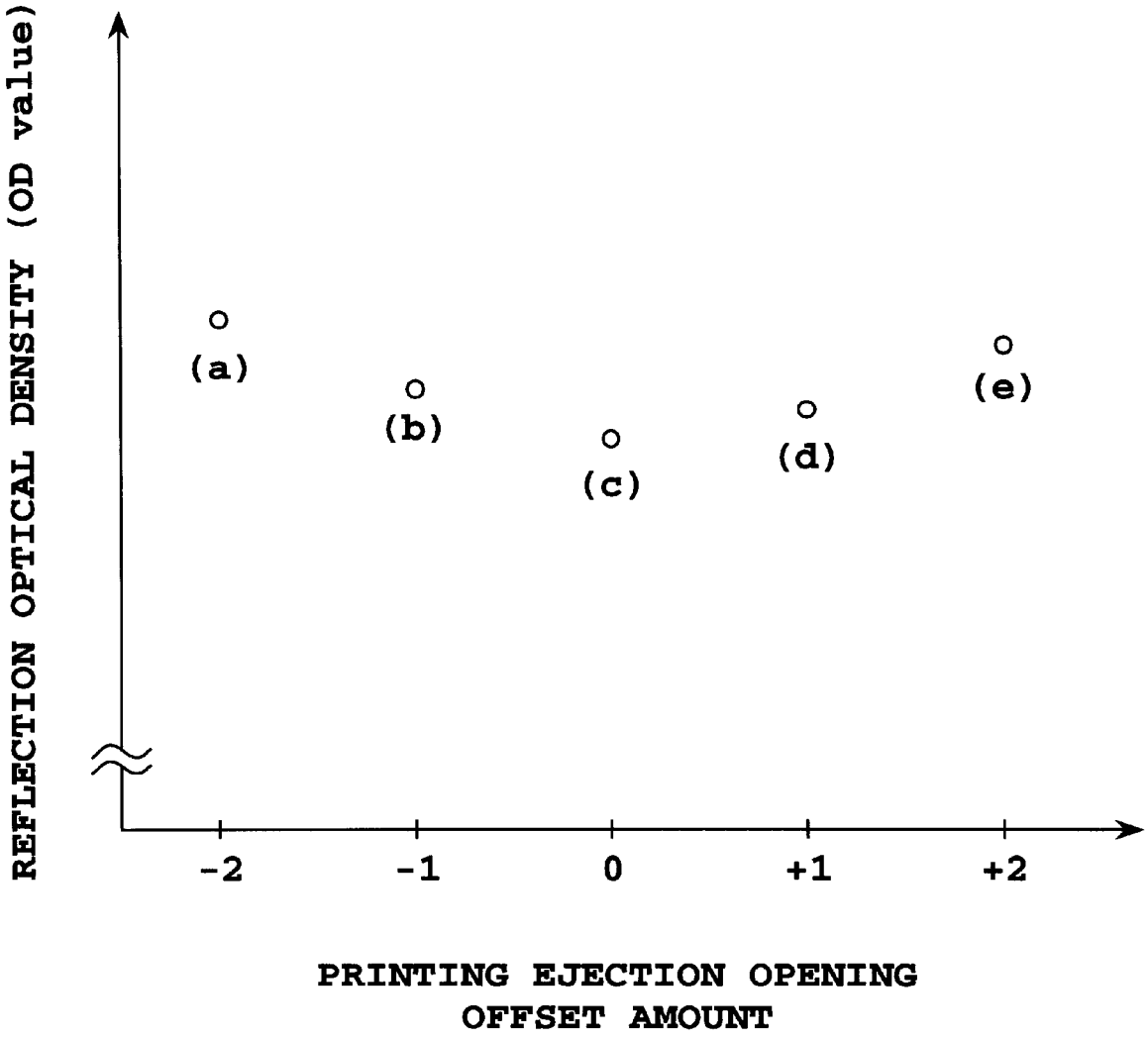
FIG. 22 shows a relationship between printing ejection opening offset amount and reflection optical density in the third embodiment of the present invention.

FIG. 22 diagrammatically shows an example of the measured reflection optical density.

In FIG. 22, the vertical axis represents the reflection optical density and the horizontal axis represents offset amount of the printing ejection openings.

Among values of the measured reflection optical density, in the shown embodiment, the printing condition where the reflection optical density becomes the minimum ((c) in FIG. 22) is selected as the condition where the best printing registration is established.

In each of the foregoing embodiment, while embodiments in the printing apparatus forming an image by ejecting the ink from the head cartridge toward the printing medium 8 has been illustrated, the present invention is not specified to the shown construction. After moving the head cartridge and the printing medium 8 relative to each other, the present invention is effectively applicable for any printing apparatus performing printing by forming dots.

Various printing patterns shown in the first embodiment is not specified for printing registration in bidirectional printing, and can be applicable for printing registration in the longitudinal and transverse direction between the print heads shown in the second and third embodiments.

The second and third embodiments show examples concerning a relationship between two head cartridges, they may be equally applicable for a relationship between three or more head cartridges. For example, with respect to three heads, printing registration is established between the first head and the second head, and then printing registration is established between the first head and the third head.

Fourth Embodiment (Optimal Ejection Duty Judgment Pattern)

In the printing registration of the forward scan and the reverse scan, if the user uses the ink or the printing medium easily cause bleeding, in a region where the dots printed in the first printing in the forward scan and the dots printed in the second printing in the reverse scan are located adjacent to each other in the pattern for printing registration, the area factor in the patch may not be caused significantly even by varying relative printing registration condition for the forward scan and the reverse scan, due to bleeding. Accordingly, it is difficult to precisely establish printing registration to possibly cause erroneous judgment. For example, when printing is performed with the ink or the printing medium easily causing bleeding, dots formed in the forward scan and the reverse scan may be connected due to bleeding of the dots even when the printing positions in the forward scan and the reverse scan are differentiated to make difference of the density small to cause difficulty in selecting the optimal printing positions. Concerning printing registration between a plurality of heads in the direction longitudinal to the carriage scanning direction, different kinds of inks are basically used. Depending upon composition of the ink or the like, there are some combination to easily cause bleeding between the ink dots upon printed on the printing medium.

FIGS. 23A to 23D diagrammatically illustrate manner of judgment of the optimal deposition duty to be used in the shown embodiment.

Figure 23A:
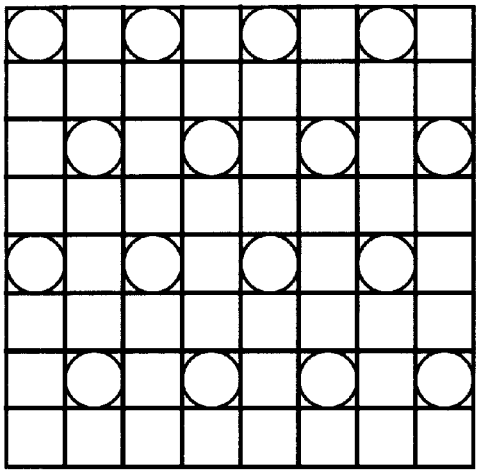
FIGS. 23A to 23D are diagrammatic illustrations for explaining printing patterns determining optical ejection duty in the forth embodiment of the present invention.
Figure 23B:
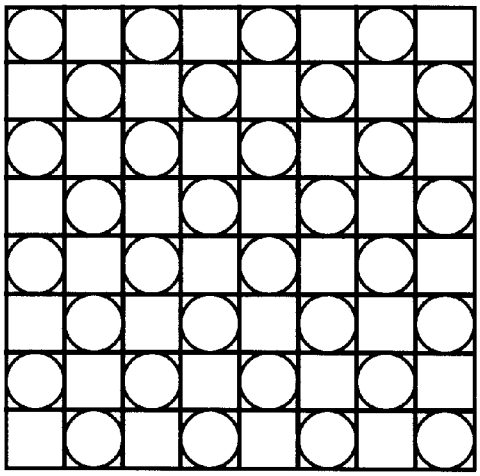
Figure 23C:
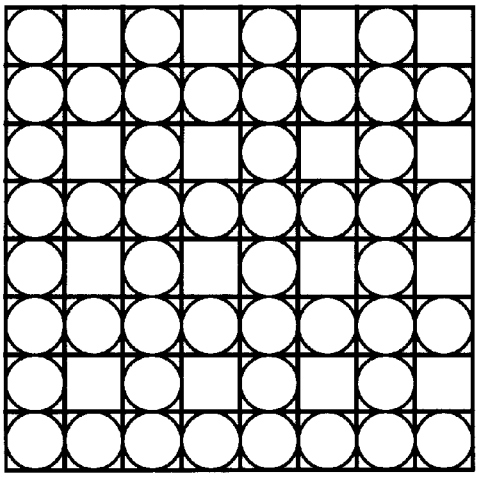
Figure 23D:
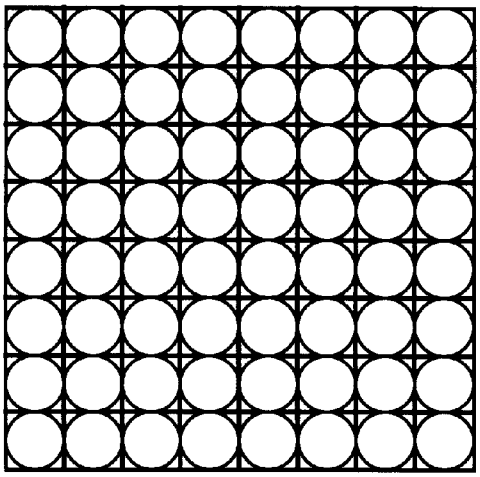

FIGS. 23A to 23D show results of printing with varying area factor from 25% to 100% in a rate of 25%. FIG. 23A shows a result of print at 25% of the area factor. FIG. 23B shows the result of printing at 50% of the area factor, FIG. 23C shows the result of printing at 75% of the area factor, and FIG. 23D shows the result of printing at 100% of the area factor. Manner of thinning of the dots in respective patterns may be either uniform or random.

Figure 24:
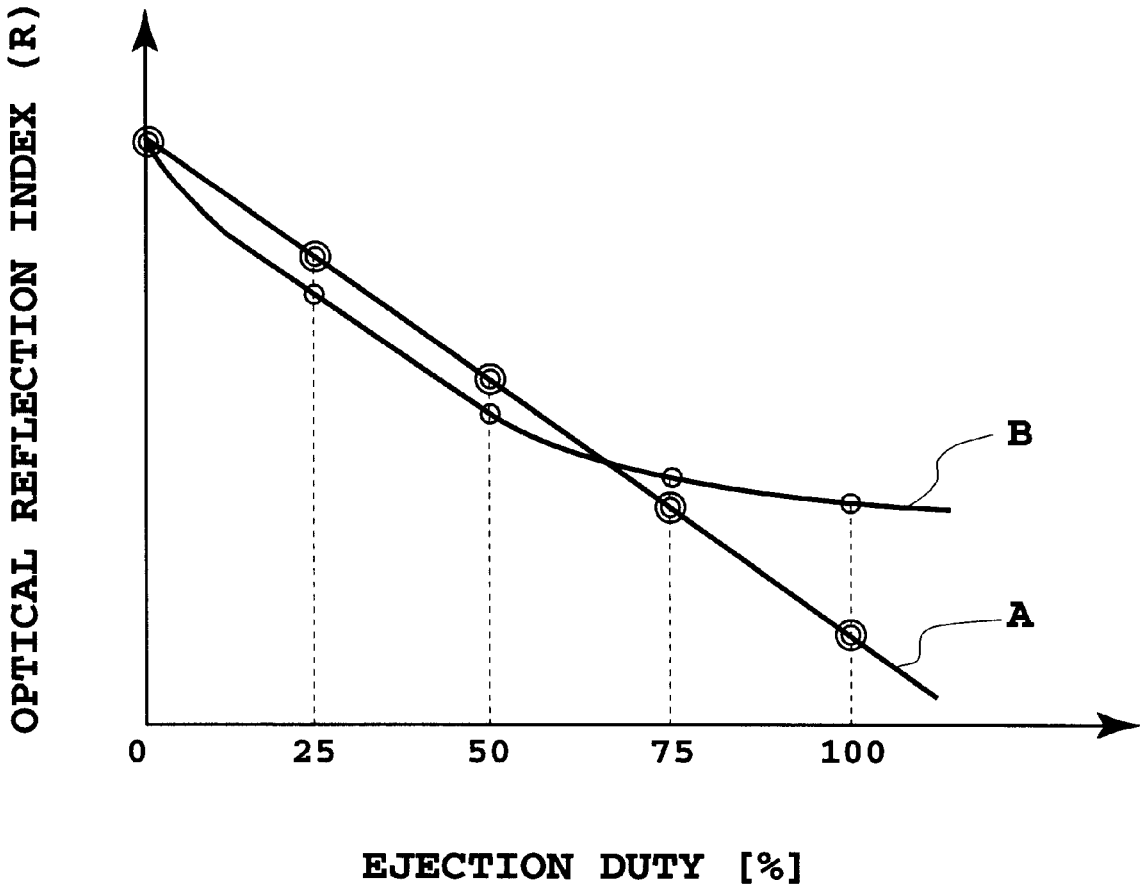
FIG. 24 is an illustration showing a relationship between the ejection duty and the optical reflection index in the forth embodiment of the present invention.

FIG. 24 shows a result of measurement of the optical reflection index of the pattern. In the shown embodiment, the patterns are formed by the same head cartridge and the same ink.

In FIG. 24, the vertical axis represents the optical reflection index and the horizontal axis represents the ink ejection duty. Depending upon relationship between the printing medium 8 and the ink to be used, when variation of the optical reflection index shows linear relationship with the ink ejection duty, the pattern for printing registration is printed at 100% of ejection duty as shown by a curve A. As shown by a curve B, it is possible that the optical reflection index enters into a saturation region at a certain ink ejection duty. In this case, the pattern for printing registration has to be printed up to the ink ejection duty not entering into the saturation region. By this, an optimal ink ejection duty depending upon the ink and the printing medium to be used can be judged to print the printing registration pattern at the optimal ink ejection duty. Thus, printing registration can be well established.

It can be understood that it is preferable to use the region of around 50% of deposition amount.

(Reflecting Ink ejection duty in printing registration Pattern)

Figure 25A:
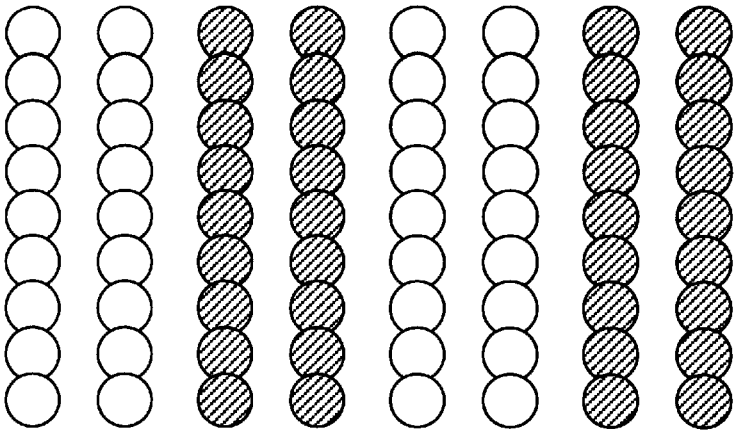
FIGS. 25A to 25C are diagrammatic illustrations showing a pattern thinned into half from a printing registration reference pattern in the forth embodiment of the present invention.
Figure 25B:
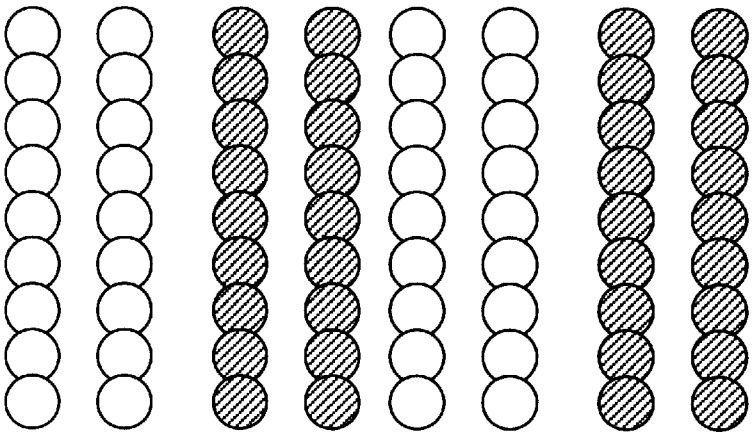
Figure 25C:
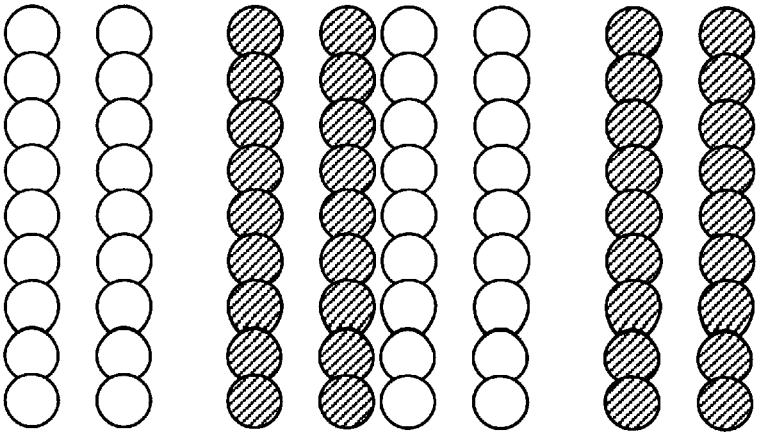

FIGS. 25A to 25C diagrammatically illustrate patterns, for example of 50% of deposition amount, in which the dots in the printing registration reference pattern is thinned into half in the direction of scanning.

FIG. 25A shows the case where the printing positions of the white dots and the hatched dots are consistent. FIG. 25B shows the case where the printing positions of the white dots and the hatched dots are slightly offset. FIG. 25C shows the case where the printing positions of the white dots and the hatched dots are offset in greater amount than that of FIG. 25B. Manner of thinning of the dots is to uniformly thin the dots in the carriage scanning direction of the printing pattern in printing registration for bidirectional printing. The thinning rate may be determined on the basis of the result of judgment of the optimal ink ejection rate so that printing can be performed at the thinning rate adapted to the printing medium and the ink.

(Example of Performing Simultaneously Determining Deposition Date and Printing Registration)

It is possible to simultaneously perform judgement of the optimal ink ejection duty and printing registration.

Figure 26A:
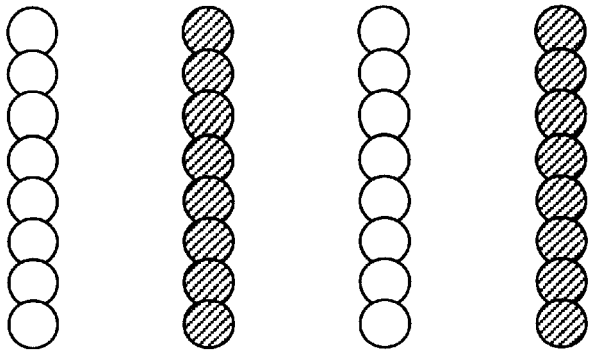
FIGS. 26A to 26D are diagrammatic illustrations showing a pattern simultaneously performing an optimal ejection duty judgment and a printing registration in the fourth embodiment of the present invention.
Figure 26B:
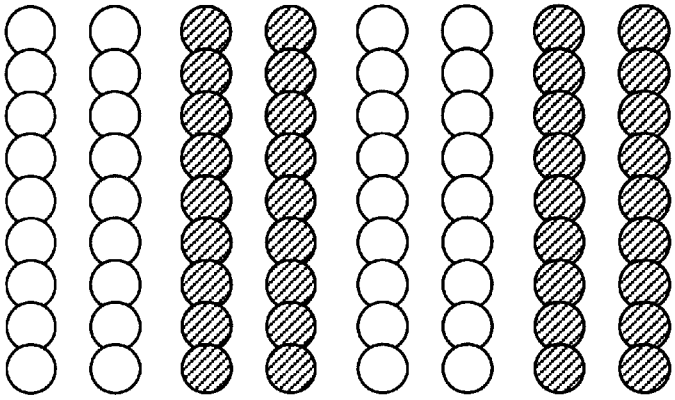
Figure 26C:
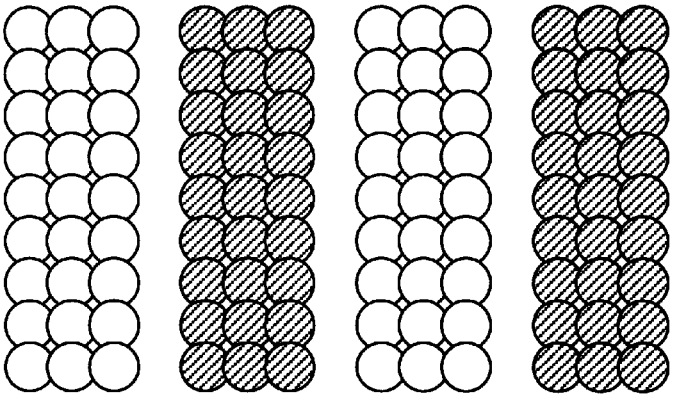
Figure 26D:
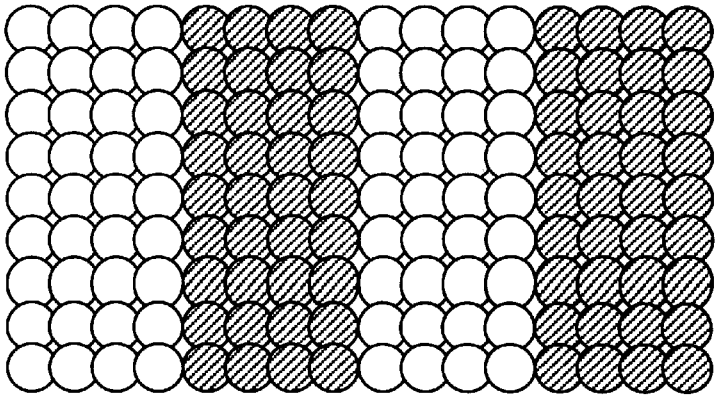

FIGS. 26A to 26D diagrammatically show patterns for simultaneously performing the optimal ink ejection duty judgment and printing registration. FIG. 26A shows the case where the printing registration pattern to be printed by the first head and the second head is printed at 25% of the ink ejection rate. Similarly, FIGS. 26B to 26D show patterns printed respectively at 50%, 75% and 100% of the ink ejection duty.

Figure 27:
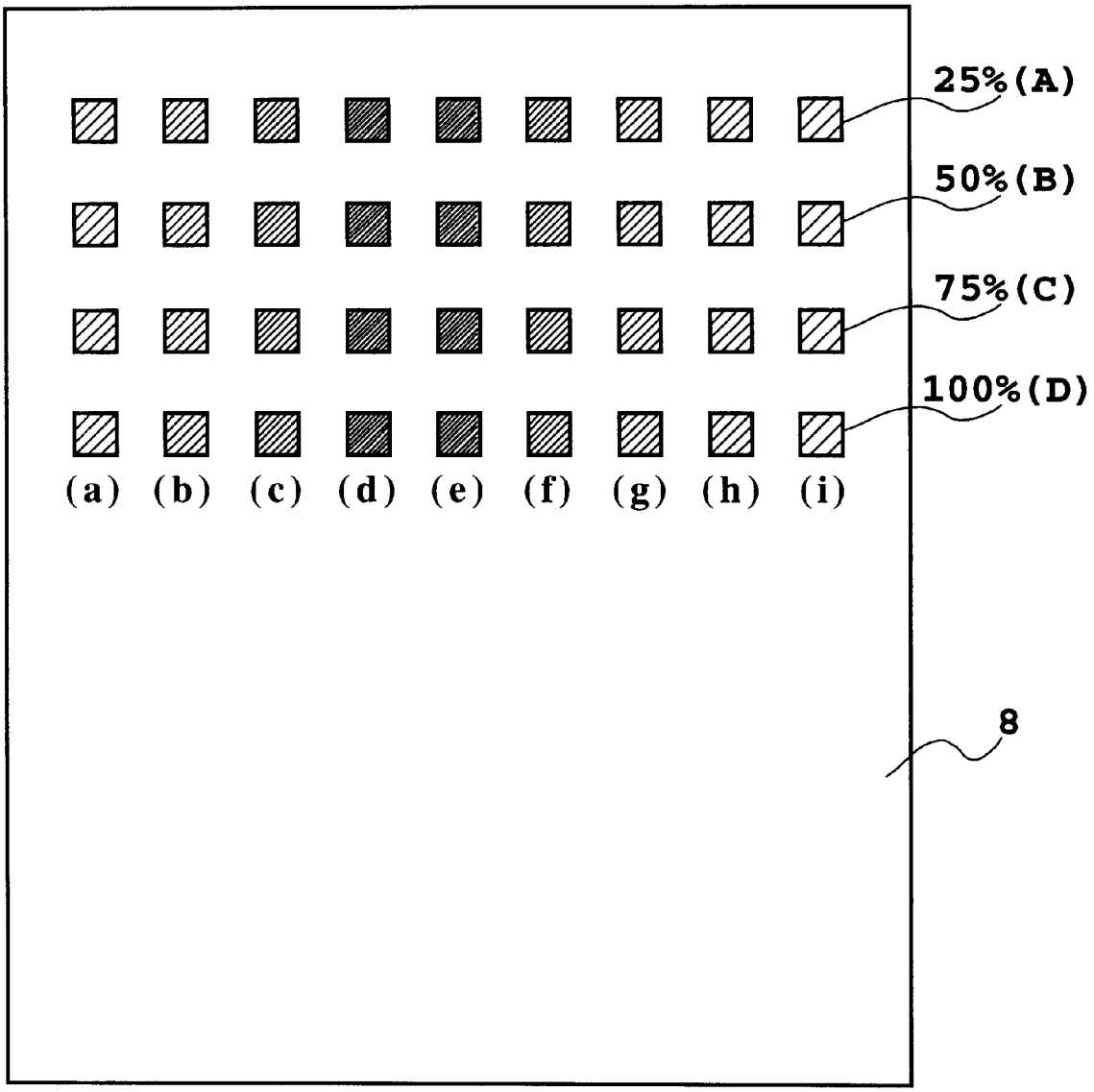
FIG. 27 is a diagrammatic illustrations showing a condition where the printing patterns are printed on a printing medium in the fourth embodiment of the present invention.

FIG. 27 shows a condition where patterns (a) to (i) are printed at respective ink ejection duties.

In FIG. 27, the patches in the first row are printed at 25% of the ink ejection duty. Similarly, the patches in the second row are printed at 50% of the ink ejection duty, the patches in the third row are printed at 75% of the ink ejection duty, and the patches in the fourth row are printed at 100% of the ink ejection duty.

Figure 28:
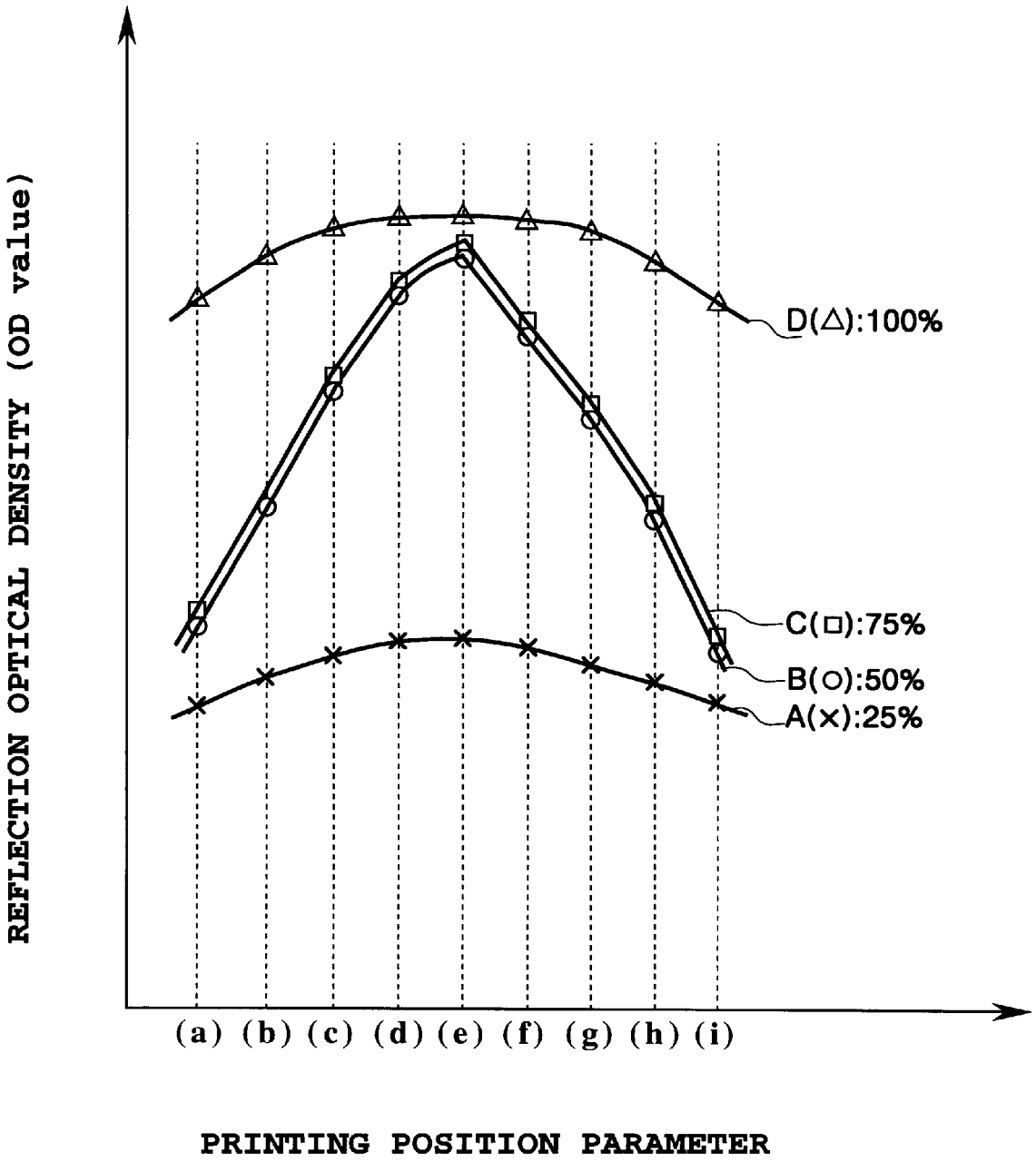
FIG. 28 is an illustration showing a relationship between a relative offset amount of the printing registration pattern and the reflection optical density in the fourth embodiment of the present invention.

FIG. 28 shows a relationship between a relative offset amount of the printing registration patterns and the reflection optical density measured at respective ink ejection duties. When the ink ejection duty is insufficient, even when offset amount of the printing registration patterns is increased, sufficient contrast cannot be attained to make variation of the reflection optical density small (curve A). On the other hand, if the ink ejection duty is excessive, overlapping of the dots can be caused to make variation amount of the optical reflection index too small even when the offset amount of the printing registration patterns is increased (curve D). From the curves of respective ink ejection duties, the ink ejection duty where the variation amount becomes largest, is derived to perform optimal printing registration from the curve of the ink ejection duty.

In FIG. 28, both curves B and C show the same amount of variation, so either of the curves may use. It is noted that in the same amount of variation, it is desired to use curve B which has a small deposition rate for suppressing the affection of cockling.

Fifth Embodiment

The fifth embodiment performs printing registration in the carriage scanning direction between a plurality of heads.

(Explanation of Printing Registration Pattern)

Concerning the printing pattern explained in the fourth embodiment, dots printed in the forward scan is printed by the first head in the shown embodiment, and the dots printed in the reverse scan is printed by the second head in the shown embodiment for performing printing registration. Judgment method of the printing registration condition is similar to the fourth embodiment.

(Optimal Ink Ejection Duty Judgment Pattern)

Concerning use of a plurality of heads, the pattern for making judgment of the optimal ink ejection duty is printed similarly to the fourth embodiment for measuring the optical reflection index for respective patches. By distribution of the optical reflection index, a linear region where the optical reflection index with respect to the ink ejection duty is linearly varied is derived. The ejection duty where the optical reflection index is the smallest in the linear region is derived for each head. Subsequently, the printing registration is performed for the optimal ink ejection duty. By this, printing registration can be well established. The judgment method the optimal ink ejection duty is similar to the fourth embodiment.

(Reflecting Ink Ejection Duty to Printing Registration Pattern)

On the basis of the result of judgment of the foregoing optimal ejection duty similarly to the fourth embodiment, a preliminarily prepared printing registration pattern is printed at the tinning rate adapted to the printing medium and the ink. Manner of thinning is to uniformly thin the dots in the longitudinal direction of the printing pattern in printing registration between the heads.

It is possible to simultaneously perform the optimal ink ejection duty judgement and printing registration similarly the foregoing fourth embodiment. With varying the ink ejection duty and the condition for printing registration set forth above, printing is performed by the first head and the second head. Then, by means of the optical sensor 30, the optical reflection indexes of respective patches are measured. On the basis of distribution of the optical reflection indexes, a linear region where the optical reflection index varies linearly is derived. Then, the ink ejection duty, at which the optical reflection index becomes the smallest in the linear region, is derived to derive the optimal printing registration condition at the derived ink ejection rate.

Sixth Embodiment

The sixth embodiment is adapted to perform printing registration in the direction perpendicular to the carriage scanning direction between a plurality of heads.

(Explanation of printing registration Pattern)

In the shown embodiment, a printing pattern where a relationship between longitudinal and lateral direction is reversed from the printing pattern explained in the fifth embodiment, is used. The judgment method the printing registration condition is similar to the fourth embodiment.

(Optimal Ink ejection duty Judgment Pattern)

Concerning a plurality of heads to be used similarly to the fifth embodiment, a pattern for making judgment of the optimal ink ejection duty similar to the fifth embodiment, respectively, is printed to measure the optical reflection indexes for respective patches. By distribution of the optical reflection indexes, the linear region where the optical reflection index varies linearly relative to the ink ejection duty is derived. The ejection duty where the optical reflection index is the smallest in the linear region is derived for each head. Subsequently, the printing registration is performed for the optimal ink ejection duty. By this, printing registration can be well established. The judgment method the optimal ink ejection duty is similar to the fourth embodiment.

(Reflecting Ink ejection duty to printing registration Pattern)

On the basis of the result of judgment of the foregoing optimal ejection duty similarly to the fourth embodiment, a preliminarily prepared printing registration pattern is printed at the tinning rate adapted to the printing medium and the ink. Manner of thinning is to uniformly thin the dots in the latitudinal direction of the printing pattern in printing registration between the heads.

It is possible to simultaneously perform the optimal ink ejection duty judgement and printing registration similarly the foregoing fourth embodiment. With varying the ink ejection duty and the condition for printing registration set forth above, printing is performed by the first head and the second head. Then, by means of the optical sensor 30, the optical reflection indexes of respective patches are measured. On the basis of distribution of the optical reflection indexes, a linear region where the optical reflection index varies linearly is derived. Then, the ink ejection duty, at which the optical reflection index becomes the smallest in the linear region, is derived to derive the optimal printing registration condition at the derived ink ejection rate.

While examples in the printing apparatus forming an image by ejecting the ink from the head cartridge to the printing medium have been illustrated in the shown embodiment, the present invention is not limited to the shown construction. The present invention is applicable for the printing apparatus performing operation of the head, for forming dots on the printing medium.

Seventh Embodiment

The seventh to tenth embodiments are suitable for performing printing using high density and low density inks employing the printing apparatus shown in FIGS. 1 and 2.

Printing can be performed by using both of the high density ink and an ink prepared by diluting the high density ink into about three or four time diluted ink (low density ink), or by solely using the diluted ink (low density ink). In this case, due to increasing of the case where the head cartridge is exchanged for printing of image primarily consisted of text and for printing of image primarily consisted of graphic image, it becomes necessary to frequently perform printing registration.

However, when the user selects the condition where the printing positions are well matched by visual observation, the ruled lines are printing on the printing medium by the high density ink and the low density ink. As a result, since the printing registration condition is determined by the user, it is possible to make it difficult to judge by visual observation when the low density ink is used.

Figure 29A:
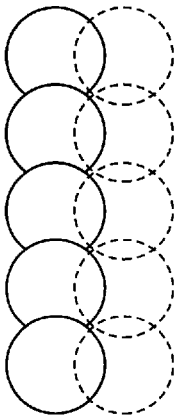
FIGS. 29A to 29C are diagrammatic illustrations showing a pattern simultaneously performing an optimal ejection duty judgment and a printing registration in the seventh embodiment of the present invention.
Figure 29B:
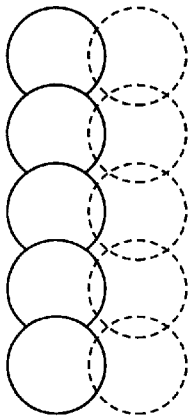
Figure 29C:
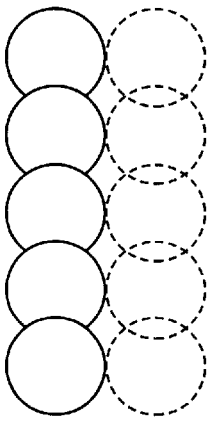

FIGS. 29A to 29C show printing registration between the high density ink and the low density ink.

In FIGS. 29A to 29C, FIG. 29A shows the case where the printing positions of the white dots and the hatched dots are consistent. FIG. 29B shows the case where the printing positions of the white dots and the hatched dots are slightly offset. FIG. 29C shows the case where the printing positions of the white dots and the hatched dots are offset in greater amount than that of FIG. 29B. The solid lines represent the lines formed by the high density ink and the broken lines represent the lines formed by the low density ink. Upon performing printing registration automatically, printing registration in the case where both of the high density ink and the low density ink are used, and printing registration in bidirectional printing between the heads, a difference of densities of the result of printing by the high density ink and the low density ink becomes large. Accordingly, by performing printing of the automatic printing registration pattern, such as the patches with vary relative position of the high ink (high density dots) and the low ink (low density dots) as shown in FIGS. 26A, 26B and 26C, the density of the high density ink is dominant. Therefore, density variation corresponding to variation cannot be obtained by the optical sensor to be possible to perform optimal automatic printing registration. Even in printing registration for bidirectional printing employing the low density ink, a sufficient density cannot be obtained to possible make printing registration impossible.

(Selection Process of printing registration Condition)

After printing the patches as printing pattern for printing registration, when measurement of the reflection optical density of the pattern is performed, in the seventh embodiment, a value of the minimum density necessary for perform printing registration and a minimum density value necessary for performing printing registration in density variation upon providing offset in the relative position of the dots formed by the first print and the second print, are defined preliminarily. Those values are set as predetermined values. When the result of measurement shows that the reflection optical density is in excess of the predetermined value, the process is advanced to the following printing registration process.

Figure 30A:
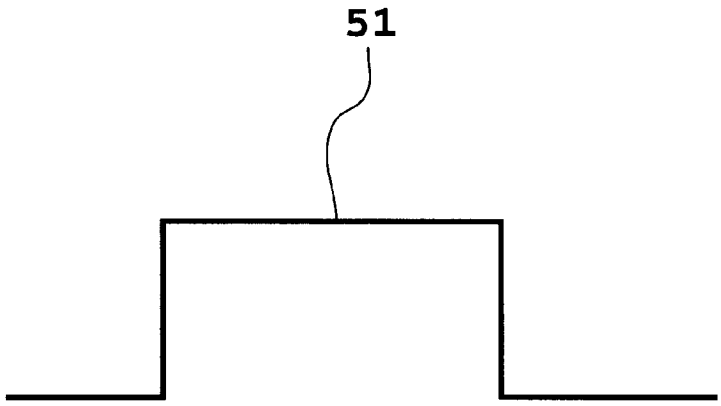
FIGS. 30A and 30B are illustrations showing a drive pulse of the printing head in the seventh embodiment of the present invention.
Figure 30B:
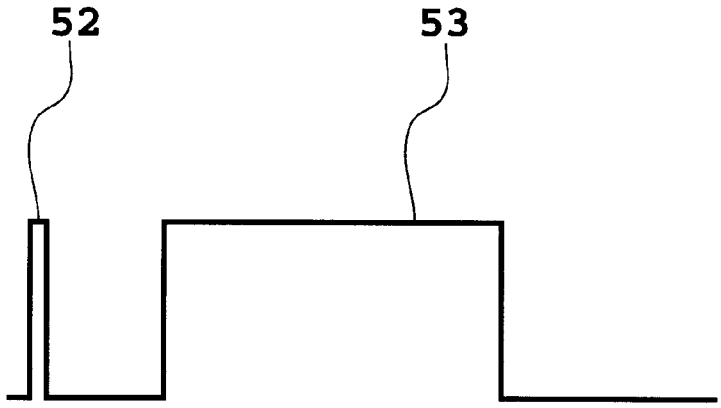

FIGS. 30A and 30B show drive pulses for a head cartridge. When a value exceeding the predetermined value cannot be obtained from the result of printing, a pulse to be used for driving an electrothermal transducer is modified from a normal single pulse 51 shown in FIG. 30A to a double pulses 52 and 53 shown in FIG. 30B. Subsequently, patches are printed again. Then, the reflection optical density is measured again. If the value exceeding the predetermined value is obtained through this process, the process is advanced to the printing registration process similarly to the above. Even if the value exceeding the predetermined value is not yet obtained, the pulse width of the pre-heating pulse 52 is increased to advance the process to the printing registration process. In the shown embodiment, the foregoing process is established under a premise that a sufficient density for printing registration process can be obtained.

The fact that by modulation from the single pulse 51 to the double pulses 52 and 53, the ejection amount of the ink can be varied, and that by varying the pulse width of the pre-heating pulse, the ink ejection amount can be varied, has been disclosed in Japanese Patent Application Laid-open No. 5-092565 (1993).

Upon checking whether the ink density is in excess of the predetermined value or not, simple patches for density measurement are prepared separately. By printing such simple patches in advance of printing registration, density is measured. It is possible to advance the process of printing of the printing pattern for printing registration and selection of the printing position after varying the ejection amount according to the foregoing method.

Adjustment of the printing density can be performed by varying number of ink droplets to be ejected on the pixel instead of varying the ejection amount of the ink. For example, if the dye density ratio of the high density ink and the low density ink is 3:1, the near density as the density obtained by ejecting one ink droplet of the high density ink can be obtained by ejecting three ink droplets of the low density ink. In consideration of bleeding caused by the printing medium 8, it is possible to set the number of the low density ink droplets to be two.

Eighth Embodiment

The eighth embodiment is directed for a printing method performing respective printing by the first print and the second print employing a plurality of head cartridges for forming the image. In detail, in a printing method forming an image by performing a printing in the forward scan and the reverse scan, relative printing registration of the printing positions in the forward scan and the reverse scan is established. The construction of the printing apparatus to be used in the shown embodiment and the printing pattern for printing registration are similar to the foregoing seventh embodiment. Concerning printing registration process, in place of the first print and the second print in the foregoing seventh embodiment, printing registration can be similarly established by using printing in the forward scan and printing in the reverse scan.

(Selection Process of printing registration Condition)

In the shown embodiment, the dots printed in the first head cartridge is printed in the forward scan and the dots printed in the second head cartridge is printed in the reverse scan for performing selection process of the printing registration condition, in the seventh embodiment.

Figure 31:
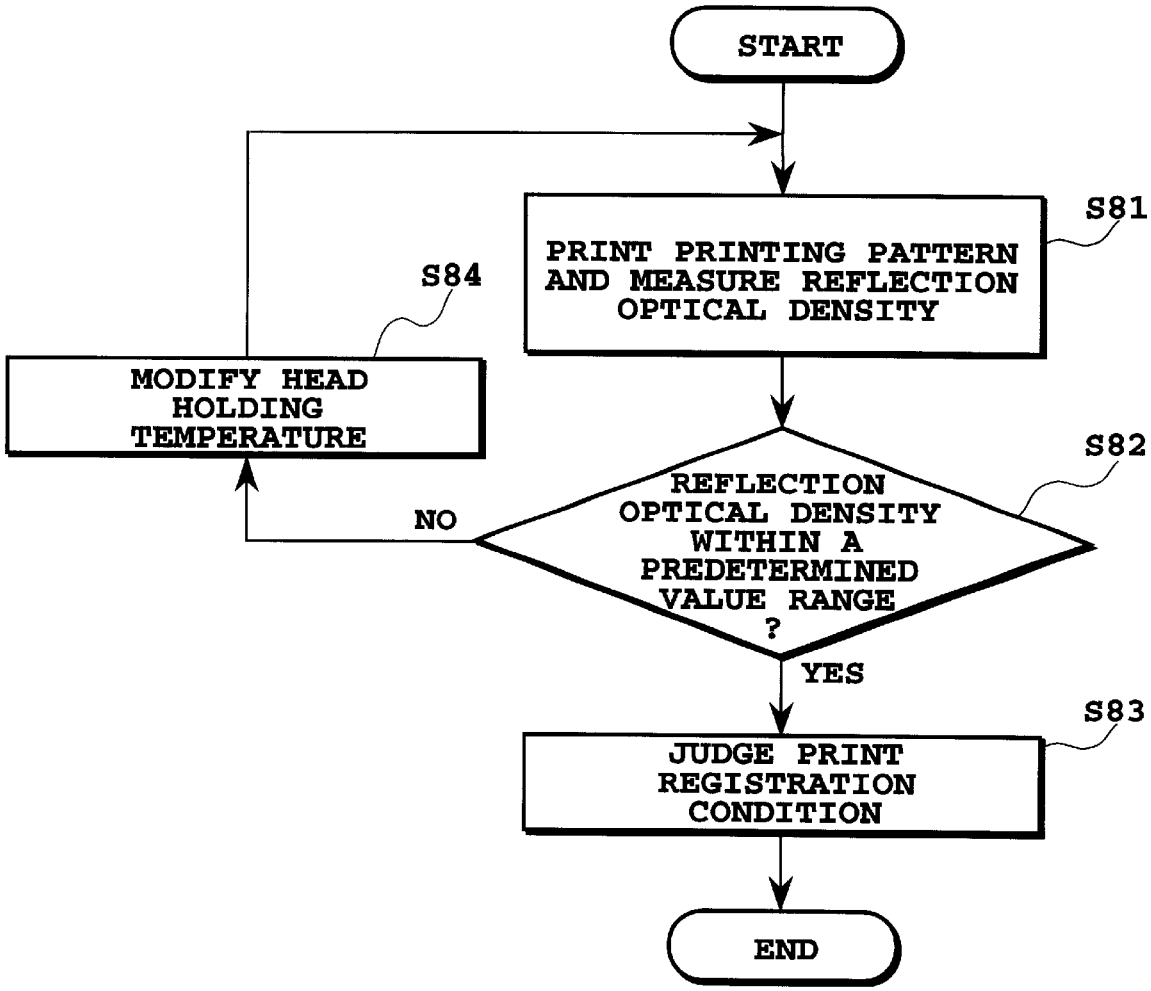
FIG. 31 is a flowchart showing a procedure of printing registration condition selecting process in the eighth embodiment of the present invention.

FIG. 31 is a flowchart showing a procedure of selection process of the printing registration condition in the shown embodiment.

As shown in FIG. 31, the printing pattern is printed at step S81. Then, measurement of the reflection optical density of the printed pattern is performed similarly to the seventh embodiment.

Next, at step S82, check is performed whether the highest reflection optical density among the measured reflection optical densities falls within the predetermined value. When the result of checking shows that the highest reflection optical density falls within the predetermined value, the process is advanced to step S83.

When the reflection optical density is smaller than the predetermined value, the process is advanced to step S84. By means of a sub-heater 142 (FIG. 6) mounted on the head cartridge 1, a holding temperature of the ink of the head is varied (from normal 23° C. to 30° C. for the first time, from 30° C. to 35° C. for the second time) to elevate the temperature of the ink. After thus increasing the ejection amount of the ink by film boiling, the process is returned to step S81.

A large number of varying patterns of the holding temperature are preliminarily set with small temperature steps. It is also possible to increase number of times of judgment by permitting further variation of the holding temperature when the reflection optical density is judged to be still inappropriate. However, in the shown embodiment, variation patterns of the temperature are to be three (23° C., 30° C. and 35° C.). Even when judgment is made that the result of the second judgment is still inappropriate, the process is advanced to step S83 after varying the holding temperature.

In the shown embodiment, the sub-heater 142 is employed for holding temperature of the ink. However, it is also possible to hold the temperature by driving the ejection heater 25 employed for ejection of the ink.

In printing registration in the carriage scanning direction between the forward and the reverse printing, printing registration with further higher precision can be performed by controlling the ink deposition amount for the ink having lower ink density in the first and second printing.

Ninth Embodiment

The ninth embodiment is a printing method for performing printing by the first head and the second head employing a plurality of head cartridges to form the image. In detail, the ninth embodiment concerns printing registration in the carriage scanning direction between different heads of the first head and the second head.

A construction of the printing apparatus to be employed in the shown embodiment, the printing patterns for printing registration and the printing registration process are similar to those of the seventh embodiment set forth above.

In the head cartridge, the ink density to be loaded in the head and the condition for ejecting the ink amount required upon printing registration using the ink are stored. By printing the printing registration pattern using this condition, the printing registration process is performed on the basis of the result of printing. Thus, optimal register position can be selected.

Tenth Embodiment

The tenth embodiment is directed to a printing method for performing printing by the first head and the second head, respectively, with employing a plurality of head cartridges to form the image. Particularly, the tenth embodiment concerns printing registration in the carriage scanning direction between different heads, i.e. the first head and the second head.

At first, the printing patterns explained later are printed on the printing medium 8 with varying relative printing registration condition of printing of the first head and the second head. Then, the user visually selects the condition where the best printing registration is established. Subsequently, by operating the host computer, the printing registration condition is set.

The construction of the printing apparatus in the shown embodiment is the construction where optical sensor 30 set on carriage 2 shown in diagrammatic illustration in FIGS. 1 or 2 is removed from the construction in seventh embodiment.

(Printing Pattern for printing registration)

Figure 32:
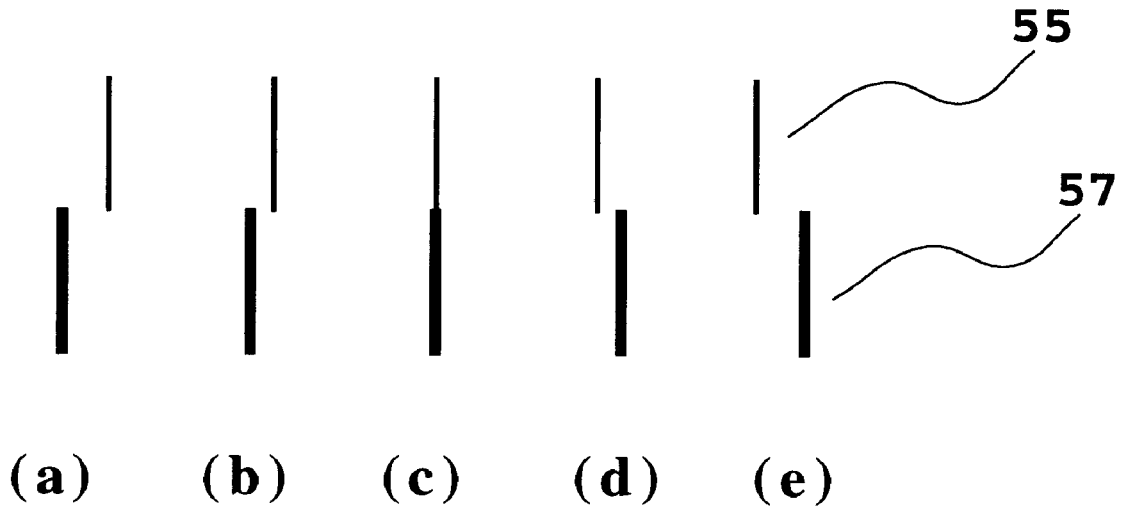
FIG. 32 is an illustration showing a printing pattern to be used for printing registration in the tenth embodiment of the present invention.

FIG. 32 is a printing pattern for printing registration to be employed in the shown embodiment.

In FIG. 32, an upper thin ruled line 55 is a ruled line printed on the printing medium by the first head, and a lower thick ruled line 57 is a ruled line printed on the printing medium by the second head. (a) to (e) represent printing positions. The printing position (c) shows the ruled line as printed in the condition where the printing conditions of the first head and the second head are matched. The printing positions (b) and (d) are ruled lines printed in the condition where the printing positions of the first and second heads are slightly offset. The printing positions (a) and (e) are ruled lines printed in the condition where the printing positions of the first and second heads are offset in greater amount.

(Selection of printing registration Condition, printing registration Process)

Upon implementation of printing registration employing the printing registration pattern, the conditions, such as the ink to be loaded and ejection amount upon printing registration are preliminarily stored in the head cartridge. At this time, the printing condition for printing registration is set in such a manner that if the loaded ink is the low density ink, twice ejection for the same pixel is used. After printing the printing pattern for printing registration under this condition, the condition where the best printing registration is established, is visually selected among the printed patterns by the user. Thereafter, the printing registration condition is set by operating the host computer.

The respective of foregoing first to tenth embodiments may be used with arbitrary combination so that better printing registration can be established.

Concerning anyone of the first to ninth embodiments, various conditions, such as the driving frequency or the head temperature or so forth for printing the printing pattern for printing registration, can be different from the driving frequency or the head temperature to be used for actual printing. Therefore, after judgment of the printing registration condition, correction is performed with respect to difference of the driving frequency, the head temperature or the like as required. The correction can be done arithmetically using some equations. In the alternative, data of the printing timing concerning actual conditions is preliminarily prepared for each printing pattern. According to the result of judgment of condition of printing registration, those are used as printing timing as they are. In the alternative, the printing timing is derived by interpolation.

In the above embodiments, it is explained to use print head in ink-jet type, the present invention may be applicable to print head of thermal-transfer-type and thermal-sublimation-type. And the print head of the present invention is a concept including print unit of electrophotography-type, so the present invention mat be applicable to electrophotography-type.

According to the present invention, by performing increasing the ink ejection amount per se, use of a plurality of inks and combination thereof, the printing density can be increased to enable printing registration between the heads, in which the printing densities are significantly different. Also, it becomes possible to establish printing registration in bidirectional printing.

As a result, the user may perform printing registration without paying attention for the density of the ink and combination of heads among a plurality of heads.

(Further description)

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As set forth above, according to the present invention, a plurality of patterns showing density variable depending upon offset amount thereof are formed depending upon a plurality of mutually different offset amounts of the printing positions. With respect to these patterns, printing registration process is performed on the basis of a plurality of the measured density, is performed. Therefore, the pattern showing the highest density or the lowest density among a plurality of densities can be set as a condition where the best printing registration is established.

Furthermore, according to the present invention, it becomes possible to accurately establish printing registration by avoiding influence of bleeding due to the printing medium and/or the ink to be used, deriving the ink ejection duty, and forming the printing registration pattern in the means for reading the reflection optical density, the reflected light intensity or the reflection index of the pattern printed by the printing apparatus, by the optical sensor mounted on the carriage.

As a result, without troubling user, printing registration can be established with simple construction.

The present invention has been described with respect to various embodiments, and it will now be apparent from the foregoing to those skilled in the art that changes and modifications may be made without departing from the invention in its broader aspect, and it is the invention, therefore, in the appended claims to cover all such changes and modifications as fall within the true spirit of the invention.

What is claimed is:

1. A printing apparatus performing printing on a printing medium by using a print head, comprising:

control means for controlling said print head for forming a plurality of patterns respectively having optical characteristics corresponding to a plurality of offset amounts, which plurality of patterns being patterns formed by a first print and a second print to be registered, and said plurality of patterns being formed corresponding to a plurality of offset amounts of relative printing positions of said first print and said second print;

optical characteristics measuring means for measuring optical characteristics of respective of a plurality of patterns formed by said control means; and printing registration means for performing printing registration process of said first print and said second print on the basis of respective optical characteristics of a plurality of patterns measured by said optical characteristics measuring means.

2. A printing apparatus as claimed in claim 1, wherein said first print and said second print are a print in a forward scan and a print in a reverse scan upon performing printing by bidirectionally scanning said print head on said printing medium.

3. A printing apparatus as claimed in claim 1, wherein said first print and said second print are a print by a first print head and a print by a second print head among a plurality of print heads, and said control means forms a pattern concerning an offset amount in a direction relatively scanning said first and second print head with respect to said printing medium.

4. A printing apparatus as claimed in claim 1, wherein said control means forms patterns at a pitch wider than a pitch of the printing position which said printing apparatus can be controlled.

5. A printing apparatus as claimed in claim 1, wherein said printing registration means derives a printing registration condition adapted to the printing position by calculation employing sequential values on the basis of optical characteristics data obtained by said optical characteristics measuring means.

6. A printing apparatus as claimed in claim 5, wherein said printing registration means includes means for deriving a printing registration condition including a printing position parameter more precise than said printing registration condition or a printing position parameter different from said printing registration condition.

7. A printing apparatus as claimed in claim 1, wherein said first print and said second print are a print printed by a first print head and a print printed by a second print head, and said control means forms pattern concerning the offset amount in a direction different from a direction of relative scan of said first and second print head with respect to said printing medium.

8. A printing apparatus as claimed in claim 1, wherein said control means arranges dots formed by said first print and dots formed by said second print, relative positional relationship of said dots is varied corresponding to said plurality of offset amounts for varying a ratio of said dots covering said printing medium for forming a plurality of patterns representative of optical characteristics depending upon said offset amounts.

9. A printing apparatus as claimed in claim 8, wherein said control means forms a pattern reducing density of the optical characteristics according to increasing of offset amount in said plurality of patterns.

10. A printing apparatus as claimed in claim 8, wherein said control means sets a rate of coverage of said printing medium by said dots to be approximately 100% at the maximum.

11. A printing apparatus as claimed in claim 10, wherein when said rate is approximately 100%, said control means arranges the dots formed by said first print and the dots formed by said second prints within a range from a distance where respective dots contacts with each other at least to a distance equal to a radius of one of the dots.

12. A printing apparatus as claimed in claim 8, wherein said control means forms a pattern increasing a density as the optical characteristics according to increasing of offset amount in a plurality of patterns.

13. A printing apparatus as claimed in claim 8, wherein said optical characteristics measuring means measures respective average optical characteristics of a plurality of patterns.

14. A printing apparatus as claimed in claim 13, wherein said optical characteristics measuring means measures the optical characteristics using an optical sensor and a measuring spot of said optical sensor is set to be wider than the dots of said pattern.

15. A printing apparatus as claimed in claim 13, wherein said optical characteristics measuring means has an optical sensor of a lower resolution than resolution of dots printed by said control means.

16. A printing apparatus as claimed in claim 13, wherein said optical characteristics measuring means measures the optical characteristics using an optical sensor, and an average of the optical characteristics measured by scanning said optical sensor on said pattern is taken as optical characteristics of a plurality of patterns.

17. A printing apparatus as claimed in claim 9, wherein said printing registration means derives a sequential density distribution on the basis of density as respective optical characteristics measured with respect to a plurality of said patterns and sets a condition corresponding to the maximum value of said sequential density distribution as an optimal printing registration condition.

18. A printing apparatus as claimed in claim 9, wherein said printing registration means sets a condition of offset amount corresponding to the maximum density among density as respective optical characteristics measured with respect to said plurality of patterns, as an optimal printing registration condition.

19. A printing apparatus as claimed in claim 12, wherein said printing registration means derives a sequential density distribution on the basis of density as respective optical characteristics measured with respect to a plurality of patterns and sets a condition corresponding to the minimum value of said sequential density distribution as an optimal printing registration condition.

20. A printing apparatus as claimed in claim 12, wherein said printing registration means sets a condition of offset amount corresponding to the minimum optical characteristics among optical characteristics as respective optical characteristics measured with respect to said plurality of patterns, as an optimal printing registration condition.

21. A printing apparatus as claimed in claim 1, further comprises optical characteristics modifying means for making judgement whether the optical characteristics measured by said optical characteristics measuring means is sufficient for processing printing registration by said printing registration means, and modifying the optical characteristics of the pattern formed by said control means on the basis of said judgment.

22. A printing apparatus as claimed in claim 9, further comprises pattern modifying means for making judgment whether the density as a plurality of optical characteristics measured by said optical characteristics measuring means is decreased or increased according to increasing of said offset amount in an extent enabling printing registration process by said printing registration means, and modifying said plurality of patterns to be formed by said control means on the basis of said judgment.

23. A printing apparatus as claimed in any one of claims 1 to 22, wherein said print head is for performing printing by ejecting an ink and has a thermal energy generating body generating a thermal energy to be used for ink ejection.

24. A printing apparatus as claimed in claim 1, further comprising a carriage which carries said print head, said carriage having an optical sensor mounted thereon, wherein said control means further comprises optical ejection duty judgement means for printing a plurality of patterns with varying ejection duty in a predetermined patch, shifting either or both of said carriage and said printing medium so that the optical sensor mounted on said carriage and the pattern that is printed become a corresponding position, measuring the optical reflection index with respect to the ejection duty of said patch, deriving a region where the optical reflection index with respect to the ejection duty becomes large rate of change from distribution of the measured optical reflection index, and deriving an optimal ejection duty at which the optical reflection index is maximum in said region.

25. A printing apparatus as claimed in claim 24, wherein said maximum ejection duty judgement means modifies print of printing registration pattern to be printed next on the basis of the optimal ejection duty derived by said optimal ejection duty judgment means.

26. A printing apparatus as claimed in claim 24, when said printing registration means performs print registration for the forward scan and the reverse scan, a first pattern used for the print in the forward scan and a second pattern used for the print in the reverse scan are pattern increasing the optical reflection index according to increasing of offset of printing position of said first and second patterns.

27. A printing apparatus as claimed in claim 24, wherein said printing registration means prints a first pattern to be used for the print in the forward scan and a second pattern to be used for the print in the reverse scan, shifts either or both of said carriage and said printing medium for placing said optical sensor mounting on said carriage and the pattern to be printed at corresponding positions, measures the optical reflection index of respective patches, derives the ejection duty, at which the variation amount of said optical reflection index becomes maximum, and derives the optimal printing registration condition at the derived ejection duty, when printing registration is performed for the forward scan and the reverse scan.

28. A printing apparatus as claimed in claim 1, further comprising:

a carriage which carries said print head, said carriage having an optical sensor mounted thereon, wherein said control means further comprises optimal ejection duty judgement means for printing a plurality of patterns varying ejection duty within a predetermined patches per each of a plurality of print heads, shifting either or both of said carriage and said printing medium for placing said optical sensor mounting on said carriage and the pattern to be printed at corresponding positions, measuring the optical reflection index with respect to the ejection duty of said patch, deriving a region where the optical reflection index with respect to the ejection duty becomes large rate of change from distribution of the measured optical reflection index, and deriving an optimal ejection duty at which the optical reflection index is maximum in said region.

29. A printing apparatus as claimed in claim 28, wherein said optimal ejection duty judgment means modifies print of printing registration pattern to be printed next per each head on the basis of the derived optimal ejection duty per each head.

30. A printing apparatus as claimed in claim 28, wherein said printing registration means prints the first pattern and the second pattern varying the ejection rate and the printing position, shifts either or both of said carriage and the printing medium to place the optical sensor mounted on the carriage and the printed pattern being in the corresponding positions, derives the ejection duty where the variation amount of the optical reflection index is maximum, and derives the optimal printing registration condition on the basis of ejection duty, when printing registration between the print heads in the scanning direction is established using a plurality of print heads.

31. A printing apparatus as claimed in claim 28, wherein said printing registration means prints the first pattern and the second pattern varying the ejection rate and the printing position, shifts either or both of said carriage and the printing medium to place the optical sensor mounted on the carriage and the printed pattern being in the corresponding positions, measures the optical reflection index of respective patches, derives the ejection duty where the variation amount of the optical reflection index is maximum, and derives the optimal printing registration condition on the basis of ejection duty, when printing registration between the print heads in the a direction perpendicular to the scanning direction is established using a plurality of print heads.

32. A printing apparatus as claimed in claim 5, wherein said printing registration means derives a printing registration condition adapted to the printing position by calculation using a linear approximation or a polynomial approximation.

33. A printing apparatus performing printing on a printing medium using a print head, when a pattern is formed by a first print and a second print to be registered and the patterns of the prints are performed by inks of different color development, said apparatus comprising:

control means for printing a predetermined patterns by using an ink of relatively low density for any one of said first print and said second print, and ejecting relatively large amount of ink for print of said ink of relatively low density on said printing medium;

printing registration condition selecting means for providing information of the printing position to said printing apparatus; and printing registration means performing printing registration process of said first print and said second print on the basis of said information provided by said printing registration condition selecting means.

34. A printing apparatus as claimed in claim 33, wherein said first print and said second print are a print by a first print head and a print by a second print head among a plurality of print heads, and said control means forms a pattern concerning an offset amount in a direction relatively scanning said first and second print head with respect to said printing medium.

35. A printing apparatus as claimed in claim 33, wherein said first printing and said second printing are a print in a forward scan and a print in a reverse scan upon performing printing by bidirectionally scanning said print head on said printing medium.

36. A printing apparatus as claimed in claim 34, wherein said printing registration condition selecting means permits the user to select the printing registration condition on the basis of the result of printing of the pattern and inputs said condition to said printing apparatus.

37. A printing apparatus as claimed in claim 34, wherein said control means forms a plurality of patterns respectively formed corresponding to a plurality of offset amounts of relative printing positions in said first print and said second print and representing respective optical characteristics corresponding to said offset amount, said printing registration condition selecting means measures the optical characteristics of a plurality of patterns formed by said control means and selecting printing registration condition on the basis of the result of measurement.

38. A printing apparatus as claimed in claim 34, wherein said printing registration condition selecting means preliminarily provides information to be used by the print head in said print head and relatively varies the ejecting ink amount on the basis of said information.

39. A printing apparatus as claimed in any one of claims 36 to 38, wherein said control means includes means for varying deposition amounts of said first print and said second print on the basis of the ink amount varied by said printing registration condition selecting means.

40. A printing apparatus as claimed in claim 39, wherein said means for varying the deposition amount ejects the ink having lower density in relatively large amount by varying a driving control pulse of said print head.

41. A printing apparatus as claimed in claim 39, wherein said means for varying the deposition amount ejects the ink having lower density in relatively large amount by varying an energy applied to said print head.

42. A printing apparatus as claimed in claim 39, wherein said means for varying deposition amount ejecting the ink varies a holding temperature of the head and varies the ink ejection amount.

43. A printing apparatus as claimed in claim 39, wherein means for varying the deposition amount ejects the ink for a plurality of times for the same pixel.

44. A printing method for performing printing registration of a printing apparatus which performs printing on a printing medium by a printing using a print head, comprising the steps of:

forming a plurality of patterns which are patterns formed by a first print and a second print for establish printing registration, respectively formed by corresponding to a plurality of offset amounts of relative printing positions between said first print and said second print;

measuring respective optical characteristics of a plurality of patterns formed; and performing printing registration process of the said first print and said second print on the basis of the optical characteristics of respective of a plurality of said measured patterns.

* * * * *

UNITED STATES PATENT AND TRADEMARK OFFICE

CERTIFICATE OF CORRECTION

PATENT NO. : 6,092,939
DATED : July 25, 2000
INVENTOR(S) : Hitoshi Nishkori, et al.

It is certified that error appears in the above-identified patent and that said Letters Patent is hereby corrected as shown below:

Title Page:
Item [75] Inventors:
Second Line, Change "Ohtsuka, Yokohama; Kiichiro" to
--Otsuka, Yokohama; Kiichiro--

Signed and Sealed this

Nineteenth Day of June, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,092,939
DATED : July 25, 2000
INVENTOR(S) : Hitoshi Nishikori

It is certified that error appears in the above-identified patent and that said Letters Patent is hereby corrected as shown below:

Title page,
Item [56], References Cited,
U.S. PATENT DOCUMENTS
"5,163,760 11/1992 Narduzzi" should read
--5,163,760 11/1992 Nardozzi --.

FOREIGN PATENT DOCUMENTS
"59-1233670 7/1984 Japan" should read
-- 59-123670 7/1984 Japan --.

Column 2,
Line 16, "of" (first occurrence) should be deleted.

Column 3,
Line 7, "prints" should read -- print --.
Line 8, "contacts" should read -- contact --.

Column 4,
Line 48, "a" (first occurrence) should be deleted.

Column 5,
Line 24, "a" should be deleted.

Column 6,
Line 6, "amount" should read -- amounts --.
Line 10, "amount" should read -- amounts --.
Line 26, "establish" should read -- establishing --.
Line 34, "of" (first occurrence) should be deleted.
Line 55, "that" should read -- than --.

Column 7,
Line 31, "should" should read -- ¶ It should --.
Line 35, "irrespective" should read -- irrespective of --.

Column 8,
Line 36, "another" should read -- further --.
Lines 44, 53 and 61, "a" should be deleted.

UNITED STATES PATENT AND TRADEMARK OFFICE

CERTIFICATE OF CORRECTION

PATENT NO. : 6,092,939
DATED : July 25, 2000
INVENTOR(S) : Hitoshi Nishikori

It is certified that error appears in the above-identified patent and that said Letters Patent is hereby corrected as shown below:

Column 9,
Line 20, "a" should be deleted.
Line 58, "illustrations" should read -- illustration --.

Column 11,
Line 31, "a" should be deleted.
Line 56, "is" (first occurrence) should read -- are --.

Column 12,
Line 21, "an" should be deleted.
Line 31, "with" should read -- by --.
Line 50, "becomes" should read -- become --.

Column 13,
Line 29, "depends" should read -- depending --.

Column 14,
Line 53, "head printing" should read -- head. Printing--.

Column 15,
Line 35, "to" should be deleted.

Column 16,
Line 7, "magenda" should read -- magenta --.
Line 40, "Iin 35" should read -- $I_{IN}$ 35 --.

Column 17,
Line 48, "6c" should read -- 6C --.

Column 18,
Line 10, "pattern" should read -- patterns --, and "with" should read -- by --.
Line 26, "depend" should read -- dependent --.

Column 19,
Line 2, "patterns" should read -- pattern --, and "patch," should read -- a patch, --.
Line 3, "like printing" should read -- like. Printing --.
Line 26, "(fro" should read -- (for --.
Line 35, "viewpoint" should read -- view --.

UNITED STATES PATENT AND TRADEMARK OFFICE

CERTIFICATE OF CORRECTION

PATENT NO. : 6,092,939
DATED : July 25, 2000
INVENTOR(S) : Hitoshi Nishikori

It is certified that error appears in the above-identified patent and that said Letters Patent is hereby corrected as shown below:

Column 20,
Line 10, "high" should read -- high, --.
Line 16, "characteristics" should read -- characteristic --.
Line 57, "examples" should read -- example --.
Line 61, "refection" should read -- reflection --.

Column 21,
Line 1, "data, and" should read -- data and --.
Line 65, "columns" should read -- column --.

Column 22,
Line 4, "in" should be deleted.
Line 13, "becomes" should read -- become --.
Line 32, "where" should read -- which --.
Line 50, "to" should be deleted.
Line 60, "a" should read -- an --.

Column 23,
Line 33, "two third" should read -- two-thirds --.

Column 24,
Line 2, "18c," should read -- 18C, --.
Line 56, "depend" should read -- depending --.

Column 25,
Line 14, "prepared" should read -- prepare --.
Line 16, "for" should be deleted.

Column 26,
Line 12, "with" should read -- by --, and "for" should read -- to --.
Line 56, "is" should read -- are --.

Column 27,
Line 63, "is" should read -- are --.

Column 29,
Line 15, "tinning" should read -- thinning --.
Line 41, "method" should read --method of --.
Line 61, "tinning" should read -- thinning --.
Line 67, "the" (first occurrence) should read -- in the --.

UNITED STATES PATENT AND TRADEMARK OFFICE

CERTIFICATE OF CORRECTION

PATENT NO. : 6,092,939
DATED : July 25, 2000
INVENTOR(S) : Hitoshi Nishikori

It is certified that error appears in the above-identified patent and that said Letters Patent is hereby corrected as shown below:

Column 30,
Line 25, "time" should read -- times --.
Line 58, "vary" should read -- varying --.
Line 66, "possible" should read -- possibly --.

Column 31,
Line 6, "perform" should read -- performing --.

Column 32,
Line 7, "is" should read -- are --.
Line 8, "is" should read -- are --.

Column 34,
Line 20, "for" should read -- to --.

Column 36,
Line 59', "of" (first occurrence) should be deleted.

Column 37,
Line 53, "contacts" should read -- contact --.

Column 39,
Line 40, "a" should be deleted.

Column 40,
Line 14, "a" should be deleted.
Line 25, "a" should be deleted.
Line 28, "amount" should read -- amounts --.

UNITED STATES PATENT AND TRADEMARK OFFICE

CERTIFICATE OF CORRECTION

PATENT NO. : 6,092,939
DATED : July 25, 2000
INVENTOR(S) : Hitoshi Nishikori

It is certified that error appears in the above-identified patent and that said Letters Patent is hereby corrected as shown below:

Column 42,
Line 8, "establish" should read -- establishing --.
Line 17, "of" (first occurrence) should be deleted.

Signed and Sealed this

Thirteenth Day of August, 2002

*Attest:*

*Attesting Officer*

JAMES E. ROGAN
*Director of the United States Patent and Trademark Office*